US008910837B2

(12) United States Patent
Wittenstein et al.

(10) Patent No.: US 8,910,837 B2
(45) Date of Patent: Dec. 16, 2014

(54) SLIDING-CARRIAGE GARMENT HANGER

(76) Inventors: Andreas Wittenstein, Woodacre, CA (US); Philipp Sebastian Wittenstein, Petaluma, CA (US); Nikolaus Adrian Wittenstein, Blacksburg, VA (US); Franziska Elisabeth Wittenstein, Petaluma, CA (US)

( * ) Notice: Subject to any disclaimer, the term of this patent is extended or adjusted under 35 U.S.C. 154(b) by 0 days.

(21) Appl. No.: 13/819,996

(22) PCT Filed: Aug. 31, 2011

(86) PCT No.: PCT/US2011/050033

§ 371 (c)(1),
(2), (4) Date: May 17, 2013

(87) PCT Pub. No.: WO2012/031003

PCT Pub. Date: Mar. 8, 2012

(65) Prior Publication Data

US 2013/0221041 A1 Aug. 29, 2013

Related U.S. Application Data

(60) Provisional application No. 61/402,664, filed on Sep. 1, 2010.

(51) Int. Cl.

| | |
|---|---|
| ***A47G 25/44*** | (2006.01) |
| ***A47G 25/32*** | (2006.01) |
| ***A47G 25/18*** | (2006.01) |
| ***A47G 25/28*** | (2006.01) |
| ***A47G 25/48*** | (2006.01) |
| *A41D 27/22* | (2006.01) |

(52) U.S. Cl.

CPC ..... *A47G 25/28* (2013.01); *A47G 25/32* (2013.01); *A47G 25/183* (2013.01); *A47G 25/485* (2013.01)

USPC ..... 223/89

(58) Field of Classification Search

USPC ..... 223/85–98; D20/42

See application file for complete search history.

(56) References Cited

U.S. PATENT DOCUMENTS

| | | | | |
|---|---|---|---|---|
| 71,136 | A * | 11/1867 | Clemence | 223/94 |
| 907,321 | A * | 12/1908 | Davis | 223/96 |
| 2,350,859 | A * | 6/1944 | Reckow | 223/95 |

(Continued)

FOREIGN PATENT DOCUMENTS

| | | | |
|---|---|---|---|
| FR | 2586346 | A1 | 2/1987 |
| FR | 2599612 | A1 | 12/1987 |

(Continued)

*Primary Examiner* — Ismael Izaguirre

(74) *Attorney, Agent, or Firm* — Patent Law Offices of Michael E. Woods; Michael E. Woods

(57) ABSTRACT

A hanger assembly for a garment including a neck opening and a pair of shoulder areas, including: a frame having a pair of lateral ends, each lateral end configured to support one shoulder area of the pair of shoulder areas from inside the garment; and a suspensor, coupled to the frame to transition between a pair of locations along the frame with the pair of locations including a first location generally centered between the pair of ends and a second location closer to a particular lateral end than an other lateral end, the suspensor having a suspending mode wherein the suspensor is located at the first location and an insertion-removal mode in which the suspensor is located at the second location.

8 Claims, 4 Drawing Sheets

(56) References Cited

U.S. PATENT DOCUMENTS

| | | | |
|---|---|---|---|
| 2,504,514 | A | 4/1950 | Frankl |
| 4,653,678 | A | 3/1987 | Blanchard et al. |
| 5,007,562 | A | 4/1991 | Brink et al. |

FOREIGN PATENT DOCUMENTS

| | | | |
|---|---|---|---|
| JP | 2001000305 | A | 1/2001 |
| JP | 2005143936 | A | 6/2005 |
| KR | 1020100090909 | | 8/2010 |
| WO | 2012031003 | A2 | 3/2012 |

* cited by examiner

SLIDING-CARRIAGE GARMENT HANGER

BACKGROUND OF THE INVENTION

This invention relates generally to the field of garment hangers, and more particularly but not exclusively, to hangers for hanging narrow-necked garments.

Garment hangers, also known as clothes hangers, coat hangers, or simply hangers, have been known in the art at least since U.S. Pat. No. 0,071,136 was awarded to Henry M. Clemence in November 1867. Garment hangers today are commonly constructed of plastic, metal wire, wood, or a combination of these materials, and are commercially available today for garments of differing types and sizes. Hangers for top-wear, including shirts, vests, sweaters, jackets, coats, and most blouses and dresses, conventionally support these garments with a pair of sloping spars or a single bilateral decurved spar, mimicking the human shoulders that support the garments during normal upright wearing. To conserve space in storage, these spars are generally much narrower than human shoulders. In length, properly sized, the spars extend from the inside of the garment's collar all the way to the ends of the garment's yoke, in order to avoid the unsightly puckers and wrinkles that develop in the garment around the outer ends of too-long or too-short spars when the garment is left hanging for an extended time or left to dry on the hanger.

If a garment's neck opening is narrower than the length of either of the garment's shoulders, as is usually the case, then the frame of a properly sized hanger will not fit through the garment's neck opening without stretching or tearing the garment's collar or, if the top of the garment is buttoned, ripping off the top few buttons. Thus when inserting or removing the hanger, the entire hanger must be manipulated through the bottom of the garment—a cumbersome and time-consuming process that risks damaging the garment fabric with the hanger's suspensor hook. Alternatively, if the garment is closed with buttons, a zipper, or other fasteners, one can partially or completely unfasten the garment beforehand, pass the spars of the hanger through the now widened neck opening, and fasten it again afterwards—a time-consuming process made more awkward by the absence of a human torso to hold the garment in place. Both of these solutions subject the garment to unnecessary handling and wear.

A great number of garment hanger inventions have been proposed in an attempt to surmount this problem, most of them by disassembling or collapsing the hanger into a contracted configuration to facilitate inserting or removing the hanger directly through the garment neck opening, and reassembling or expanding it inside the garment into an extended configuration to support the garment for hanging. This change in configuration is typically effected by detaching and reattaching parts of the hanger, rotating parts of the hanger relative to one another, sliding parts of the hanger relative to one another, or some combination of these three techniques. Many other top-wear garment hangers, though not expressly intended to address this problem, use the same or similar means to surmount the closely related problems of making the hanger more compact when not in use or when travelling, and of making the hanger adaptable to different sizes of garments.

Separable-Frame Hangers

A common method of making a top-wear garment hanger more compact is to divide the frame lengthwise into detachable segments. In principle, detaching segments of the frame makes it possible to insert or remove the hanger through a narrow neck piecemeal without stretching, tearing, or undoing the garment, although most such inventions were not invented with this purpose in mind. However, attempting to piece such a frame back together inside an article of clothing, either while trying at the same time to hold the article in position or within the confines of a clothing rack, is a non-trivial task. A further disadvantage of essentially all separable-frame hangers is that one or more parts can be inadvertently dropped in the process detaching or reattaching them, a particularly inconvenient mishap if the part falls into the garment and lodges in a sleeve, an interior pocket, or a fold, and has to be fished out. Detachable parts are moreover easily misplaced and lost. In a single exception, described in U.S. Pat. No. 2,613,858, awarded to Robert M. Sprague in October 1952, the parts cannot be dropped or lost, because they are permanently sewn into the garment—no doubt at the cost of significant discomfort.

Most of the separable-frame hanger designs provide detachable spar extensions, some in the form of shaped shoulder pads, which attach to the main top rail or pair of spars supporting the shoulders of narrow-necked clothing. These include U.S. Pat. No. 0,765,331, awarded in July 1904 to John Thomas Batts, as well as in U.S. Pat. Nos. 0,890,271, 1,108,848, 1,817,369, 2,155,071, 2,160,128, 2,160,129, 2,160,173, 2,160,188, 2,335,285, 2,409,708, 2,518,367, 2,524,978, 2,525,142, 2,527,312, 2,528,016, 2,562,368, 2,538,971, 2,574,963, 2,591,387, 2,613,858, 2,619,269, 2,620,102, 2,640,632, 2,652,958, 2,666,561, 2,701,083, 2,754,039, 2,814,426, 2,817,471, 2,884,171, 3,039,662, 4,895,283, 5,476,199, 5,613,627, 5,680,972, 5,718,358, 5,727,718, 5,941,429, 5,950,882, 6,062,445, 6,068,166, 6,158,634, 6,164,504, 6,206,255, 6,637,630, 6,688,503, 6,758,378, 6,811,064, and 7,077,300. Reattaching spar extensions after inserting the pieces through a narrow neck entails reaching inside the garment with one or both hands to fumble blindly under the garment's shoulders. In some such inventions, including U.S. Pat. No. 2,421,433, awarded in June 1947 to Herbert M. Poole, as well as U.S. Pat. Nos. 2,446,312, 2,500,817, 2,504,562, 2,510,375, 2,637,471, 2,709,026, 2,718,340, 2,722,351, 5,085,357, 5,579,964, 5,598,957, 6,179,174, and 6,722,538, the spar extensions are additionally joined to a bottom rail, further complicating the reassembly and requiring the user to reach even further into the garment. Similarly, in U.S. Pat. No. 2,155,071 (e.g., FIG. 7), awarded in April 1939 to Leonard A. Young, as well as in U.S. Pat. No. 2,160,128 (e.g., FIG. 2,3), the spars curve and join each other to form a bottom rail.

In several inventions, both spars are completely removable, as in U.S. Pat. No. 0,401,943, assigned in April 1889 to William Gowen, as well as in U.S. Pat. Nos. 0,779,062, 1,550,634, 2,354,099, 2,519,276, 2,562,368, 2,548,810, 2,774,526, 2,777,619, 3,587,949, 5,074,446 (e.g., FIG. 5), 5,727,718 (e.g., FIG. 12), and 6,050,460. In a few inventions, only one spar is completely removable, as in U.S. Pat. No. 2,613,858, awarded in October 1952 to Robert M. Sprague, as well as U.S. Pat. Nos. 2,808,187 and 7,246,729. Being able to completely remove one or both spars makes it possible to reassemble the coat hanger without reaching blindly inside the garment. On the other hand, it means that each spar has to support the entire weight of the respective shoulder of the garment, making assembly more awkward for heavy garments.

Folding-Frame Hangers

One of the most common methods of collapsing and expanding a garment hanger is by folding the frame at pivoting joints within the range of the garment's neck opening, thus dividing the top rail of the hanger into two spars hinged, at their proximal ends, either to each other or to a connecting bridge. All such inventions share some major drawbacks.

There is a risk of personal injury from pinching or shearing one's skin or worse in the folding mechanism, often under considerable leverage, as the hanger is collapsed, particularly under a heavy garment. Similarly, there is the risk of pinching and damaging or even shearing the fabric of the garment in the folding mechanism. The hinges themselves are focal points of friction and stress under great leverage, and tend to wear quickly, squeak, bind, wiggle, and break. Moreover, the use of hinges (9 of them in the garment hanger described in U.S. Pat. No. 3,834,598; 12 in U.S. Pat. Nos. 1,955,995, 4,221,310, and 4,223,817; 37 in U.S. Pat. No. 2,507,906) increases the complexity of the construction and hence the cost of manufacturing and the frequency of malfunction in operation.

In a large number of folding-frame garment hanger inventions, including U.S. Pat. No. 0,678,073, awarded to Frederick M. Osgood in July 1901, as well as U.S. Pat. Nos. 0,765,331, 0,778,007, 0,900,567, 0,904,249, 0,923,786, 0,932,756, 0,932,756, 0,958,366, 0,959,687, 1,040,942, 1,066,170, 1,184,288, 1,268,881, 1,495,425, 1,676,936, 1,769,076, 1,970,943, 2,166,492, 2,435,301, 2,436,314, 2,439,838, 2,440,636, 2,440,637, 2,518,367, 2,569,726, 2,577,854, 2,586,913, 2,595,026, 2,605,942, 2,629,525, 2,653,739, 2,656,078, 2,682,980, 2,699,276, 2,716,513, 2,716,514, 2,719,658, 2,723,065, 2,728,499, 2,745,579, 2,777,621, 2,782,969, 2,817,471, 2,872,090, 2,906,442, 2,926,823, 2,941,704, 3,082,921, 3,151,788, 3,315,854, 3,531,028, 3,705,673, 3,719,312, 3,802,610, 3,858,770, 4,114,786, 4,117,960, 4,186,857, 4,231,499, 4,524,890, 4,673,116, 4,730,757, 4,948,019, 4,988,021, 5,383,584, 5,397,037, 5,590,823, 5,690,257, 5,950,882, 5,979,721, 6,050,460, 6,427,882, 7,021,507, 7,036,696, 7,237,702, 7,243,823, and 7,249,699, the spars fold downward, away from the suspensor, remaining in the same plane with the suspensor shaft. Since the bulk of the weight of the garment bears downward on the outer ends of the spars, hangers with downward-folding spars always require a latching means to prevent the spars from collapsing during use, although a few, such as U.S. Pat. Nos. 0,589,901, 2,137,700, 6,540,121, neglect this necessity. This latch constitutes an inherent structural weakness making such hangers unsuitable for heavy garments, and introduces additional moving parts prone to malfunction and failure. Some inventions, including U.S. Pat. No. 0,920,240, awarded to Isak Anderson in May 1909, as well as U.S. Pat. Nos. 1,101,088, 1,216,447, 1,258,452, 1,278,054, 1,351,516, 1,370,713, 1,444,525, 1,682,626, 2,108,622, 2,413,221, 2,418,870, 2,544,170, 2,605,942, 2,906,442, 3,040,941, 4,673,115, 4,813,581, and 5,893,493, provide for heavy garments by bracing the spars open with a folding crossbar downwardly hinged at its center and attached via pivots near the distal ends of the spars, which thus extends nearly the full span of the expanded hanger. The crossbar is locked in the extended position by gravitational action on the crossbar itself, and prevented from overextending by catches on or near the hinge. However, in order to unlatch the crossbar to remove the hanger from the garment, one must inconveniently reach in blindly through the neck opening to pull upward at the crossbar hinge, increasing the risk of pinching or shearing oneself in the collapsing mechanism. In a few inventions, such as 1,286,022, awarded to Walter J. Klesat in November 1928, as well as U.S. Pat. Nos. 2,425,475 and 7,172,102 (e.g., FIG. 1), the crossbar hinge folds upwards instead of downwards when collapsed, and the spars are locked in the expanded configuration by pulling the crossbar hinge upward beyond the level point against a stop affixed beneath the crown of the hanger frame, such that the crossbar hinge is pushed upward against the stop by the weight of garment on the spars. A few inventions join the halves of the crossbar with, instead of hinge, a sliding sleeve, such as U.S. Pat. Nos. 0,678,073, 1,458,113, 1,458,114, 2,232,249, and 4,227,632 (e.g., FIG. 5, 6), or a stud, such as U.S. Pat. Nos. 5,044,534, and 6,021,932 (e.g., FIG. 12), making it even more inconvenient to disengage inside a garment, and further necessitating reaching inside the garment with one's hands to fish for the crossbar ends and engage the latch. And a few, such as U.S. Pat. No. 2,582,669, even use a turnbuckle instead of a sliding sleeve, making the process especially tedious. This problem in turn has been solved by a few inventions, including U.S. Pat. No. 1,111,147, awarded to Oscar Fogde in 1914, as well as U.S. Pat. Nos. 0,589,901, 1,886,869, 2,290,722, 2,754,038, and 2,881,965, which connect the shaft of the suspensor to the crossbar hinge, so that the latch can be operated by grasping the top of the frame and pushing the suspensor and thus the upwardly folding crossbar hinge downward to collapse the hanger, or pulling the suspensor and thus the crossbar hinge upward to unfold the spars. In a few of these, including U.S. Pat. No. 2,290,722, awarded to Murray Weingarten in July 1942, as well as U.S. Pat. Nos. 2,509,754 and 4,227,632, the spars are locked in the expanded configuration by pulling the crossbar hinge upward beyond the level point against a stop beneath the crown of the hanger frame, where the crossbar hinge is pushed upward against the stop by the weight of garment on the spars even as the crossbar hinge is pulled upward against the stop by the weight of the laden hanger on the suspensor, thus maintaining the crossbar hinge in the locked position by gravitational action. Unfortunately, this solution comes at the cost of additional complexity, with a sliding joint for the suspensor shaft through the frame crown added to a total of at least four hinged joints at the ends of the spars and crossbar segments. The downward-folding garment hanger in U.S. Pat. No. 3,858,770 also raises the spars by pulling upward on the suspensor, but without a crossbar and thus with only two hinged joints and a sliding joint, so the joint is weak and cannot support heavy garments.

In nearly as large a number of folding-frame garment hanger inventions, including U.S. Pat. No. 0,320,230, awarded in June 1885 to George H. Donaldson, as well as U.S. Pat. Nos. 0,395,884, 0,586,456, 0,589,901, 0,611,669, 0,624,415, 0,672,777, 0,713,376, 0,725,082, 0,834,946, 0,838,839, 0,847,212, 0,886,041, 0,890,023, 0,896,570, 0,900,567, 0,912,047, 0,919,501, 0,964,003, 0,964,072, 0,976,531, 0,990,515, 1,049,867, 1,097,889, 1,102,420, 1,193,357, 1,336,375, 1,336,429, 1,344,665, 1,545,765, 1,570,196, 1,673,059, 1,743,234, 1,809,561, 1,955,995 1,979,687, 2,170,479, 2,409,269, 2,448,234, 2,500,729, 2,540,508, 2,558,583, 2,576,761, 2,633,276, 2,663,470, 2,712,890, 2,724,533, 2,805,011, 3,219,241, 3,254,814, 3,334,793, 3,401,855, 3,441,183, 3,834,598, 3,874,572, 4,221,310, 4,223,817, 4,717,053, 4,915,271, 5,810,216, 5,813,578, the spars fold upward, toward the suspensor, remaining in the same plane with the suspensor shaft. Garment hangers with upward-folding spars, unlike those with downward-folding spars, do not require a latch to keep them from collapsing in use, because the weight of the garment holds them open. Nevertheless, the stop that prevents them from opening too far and collapsing downwardly is still a structural weak point prone to failure. A few inventions, including U.S. Pat. Nos. 0,855,295, 1,696,480, and 3,214,071, overcome this weakness by bracing the spars open from below with a removable crossbar attached via pins or hooks near the distal ends of the spars once the hanger is unfolded. However, in order to latch or unlatch the crossbar, one must inconveniently reach in through the neck opening of the garment and fumble blindly around to mate the ends of the crossbar with the ends of the spars. The invention disclosed in U.S. Pat. No. 5,893,493, in which the crossbar is permanently attached to the ends of the spars via pivots, and folds upward alongside the spars in the collapsed configuration, is less inconvenient, in that it only requires that one blindly locate a sleeve mounted on the crossbar and slide it into position to lock the crossbar joints. A major inconvenience shared by all hangers with upward-folding spars is that, if the hanger is to pass through the neck opening of the garment, then the spars of the hanger must be unfolded and folded by reaching inside the garment with one's hands. In fact, since the spars fold upward toward the suspensor hook, the entire hanger, hook and all, must be thrust down inside the garment prior to unfolding or folding the spars.

In a smaller set of folding-frame garment hangers, including U.S. Pat. No. 0,920,894, awarded in May 1909 to 0,920,894, as well as U.S. Pat. Nos. 2,446,312, 3,430,827, 3,703,978, 4,669,642, 5,085,357 (e.g., FIG. 4), and U.S. Pat. No. 5,145,098, the spars fold laterally, perpendicularly or askew to the axis of the suspensor, and out of the plane of the suspensor and frame in their expanded configuration. Like garment hangers with downward-folding spars and unlike those with upward-folding spars, those with sidewards-folding spars can be inserted and removed through the garment's neck opening while holding the suspensor outside the garment—provided that the suspensor can be disengaged from the clothes rod or other purchase—by tilting the hanger so that the spars hang downward from the suspensor shaft, which is held horizontally. However, this method does not apply to inventions such as U.S. Pat. Nos. 1,184,743 and 5,007,562, in which the ends of spars fold away from each other rather than toward each other. In any case, with sideways-folding spars one still needs to reach inside the garment after inserting the hanger in order to initiate prying the spars apart, which are held together by gravity, friction, and attractive forces. Some inventions, including U.S. Pat. No. 2,123,973, awarded to Norman B. Smith in July 1938, as well as U.S. Pat. Nos. 2,425,527, 2,906,442, 4,186,858, 4,997,115, 5,480,076, and 5,632,422, lessen this problem by using springs to initially force the spars apart; in practice, however, this only works if the spring is strong enough to overcome the weight and friction of the garment in addition to the weight and attraction of the spars and the friction of the hinge. Once the ends of the spars are slightly spread, they can in principle be fully unfolded by tilting the suspensor back in the opposite direction, provided that the friction against the garment is not too great. However, this action places great torque stress on the suspensor shaft and the spars, against which they would need considerable lateral stiffening for heavy garments. Alternatively, given a third hand, the spars can then be pushed apart through the fabric of the garment. In either case, however, the friction of the ends of the spars pressing out against the garment would cause undesirable wear on the fabric of the garment. A further problem is that in their expanded configuration, the laterally folding spars are only in a critically stable condition, such that a slight tilting of the hanger in the collapsing direction causes the hanger to collapse on its own under gravity, an effect reinforced by the changing weight distribution of the garment. Some inventions, including U.S. Pat. No. 0,554,643, awarded in February 1896 to Charles Behrend Jr., as well as U.S. Pat. Nos. 0,851,527, 0,881,818, 1,058,394, 1,184,743, 1,374,024, 1,453,000, 1,836,935, 1,836,942, 2,123,973 (e.g., FIG. 4), and U.S. Pat. No. 6,076,716, hold the spars in their expanded position with one or more latches, but these require inconvenient additional manipulation to close and open; and some, such as U.S. Pat. Nos. 1,184,743, 1,374,024, 1,600,949, and 1,696,480, require reaching one's hands inside the garment to operate. A few inventions, such as U.S. Pat. No. 1,181,691, awarded to William Morris Stiebritz in 1916, use catches that simply snap into place instead. A different solution is taught by U.S. Pat. No. 5,007,562, awarded to Joyce Brink & James E. Brink in April 1991, as well as U.S. Pat. Nos. 6,244,479, 6,311,880, 6,328,187, 6,345,742, and 6,431,419, in which the spars fold not strictly horizontally but diagonally upward, so that the unfolded configuration is inherently stable.

Sliding-Frame Hangers

Another very common method of collapsing and expanding a garment hanger is by telescoping the frame with sliding joints, thus dividing the top rail of the hanger into two or more overlapping or nesting spars, none longer than the width of the neck opening plus the length of one shoulder of the garment, at least one of which segments is attached to the suspensor. All such inventions share some important drawbacks. When extended, the free segments are asymmetrically cantilevered, greatly stressing the ends of the telescoping joints, which stretch, crack, and break. When collapsing and extending the frames, the telescoping joints tend to bind, especially when deformed by the weight of the garment. Friction rapidly wears out the sliding joints and the catches that prevent them from coming apart. Moreover, the use of telescoping segments (6 in U.S. Pat. Nos. 1,049,867, 1,114,002, and 2,663,470, 8 in U.S. Pat. No. 1,114,294, 10 in U.S. Pat. No. 4,004,721) increases the complexity of the construction and hence the cost of manufacturing and the frequency of malfunction in operation.

In a large number of sliding-frame garment hanger inventions, including U.S. Pat. No. 0,364,803, awarded in June 1887 to Hans Christian, as well as U.S. Pat. Nos. 0,765,331, 0,839,843, 0,892,149, 1,005,967, 1,344,665, 1,453,000, 1,638,844, 1,673,059, 1,817,369, 2,290,722, 2,362,756, 2,477,873, 2,524,978, 2,527,312, 2,591,387, 2,599,260, 2,613,858, 2,629,525, 2,633,276, 2,640,632, 2,656,955, 2,682,978, 2,682,980, 2,757,836, 2,819,828, 2,884,171, 2,906,442, 2,944,711, 3,005,579, 3,254,814, 3,874,572, 5,052,599, 5,476,199, 5,680,972, 6,068,166, 6,076,716, 6,164,504, 6,220,489, and 6,811,064, each side of the top rail telescopes separately in two segments. If the hanger is to fit through the neck opening of the garment, then this design strictly limits the length of overlap in the retracted state of a one-sided spar to half the width of the frame. In the extended state, the degree of overlap in such a unilateral spar is substantially less than the length of the cantilevered section of the distal segment, which thus exerts great imbalanced torque on the overlapping joint under the leveraged weight of the garment. A few inventions, including U.S. Pat. No. 1,049,867, awarded to Loeser Kalina in January 1913, as well as U.S. Pat. Nos. 1,245,425, 1,114,002, 1,114,294, 2,120,436, 2,488,219, 2,663,470, 3,214,071, 4,004,721, and 5,950,882 (e.g., FIG. 9), potentially increase the degree of overlap between segments of a spar by increasing the number of telescoping segments per spar, thus reducing the stress on the joints. However, this greatly increases the complexity of the construction and hence the cost of manufacture and the risk of malfunction during use. Another method of increasing the degree of overlap is to have the telescoping spars cross over to the other side, as in U.S. Pat. No. 0,071,136, awarded in November 1867 to Henry M. Clemence, as well as U.S. Pat. Nos. 0,401,943, 0,640,616, 0,665,314, 0,668,673, 0,976,094, 0,996,504, 1,018,584, 1,207,338, 1,324,679, 1,356,448, 1,377,837, 1,385,449, 1,598,747, 1,886,298, 2,096,827, 2,452,346, 2,477,873, 2,487,445, 2,519,276, 2,548,810, 2,621,834, 2,774,526, 2,781,157, 2,800,261, 3,443,729, 3,494,517, 3,799,412, 3,802,611, 5,456,391, 5,975,385, 6,158,634, and 7,246,729. However, this limits the shape of the overlapping portion of the top rail to an arc of constant curvature, just as telescoping spars in general are limited to an arc of constant curvature. A few inventions, including U.S. Pat. No. 5,511,701, awarded to Peter Ar-Fu Lam in April 1996, as well as U.S. Pat. Nos. 5,664,710, 6,409,058, and 6,644,520, overcome this limitation by using flexible materials for the overlapping portions of the spars. A further method of slightly remedying the unbalanced torque is to include a telescoping crossbar between the distal ends of the telescoping segments of the spars, as in U.S. Pat. Nos. 1,377,836, 2,354,099, 2,360,119, 2,421,433, 2,452,346, 2,472,262, 2,491,836, 2,494,272, 2,504,562, 2,524,612, 2,531,293, 2,547,436, 2,549,500, 2,637,471, 2,716,512, 2,718,340, 2,738,908, 2,817,470, 4,334,641, 4,801,057, 5,085,357, 5,579,964, 6,179,174, and 7,077,300; but unless the bar is somehow held rigid, this has little bracing effect. In a few inventions, including U.S. Pat. Nos. 2,531,108 and 5,598,957, the crossbar is indeed held quite rigid by fastening it to the telescoping spars as a turnbuckle, but operating the turnbuckle to retract or extend the spars is a tedious process and requires reaching in through the neck opening of the garment with one's hands. In U.S. Pat. No. 2,562,368, the crossbar is held quite rigid by fastening the overlapping telescoping segments of the crossbar with a setscrew, and in U.S. Pat. No. 2,500,817, the telescoping bar is held fairly rigid with pins inserted through holes aligned with a rack engaging overlapping segments of the crossbar. These solutions, while perhaps not as tedious as twisting a turnbuckle, would nevertheless present quite a challenge to operate while blindly reaching one's hands inside the garment. In yet a few further inventions, such as U.S. Pat. Nos. 2,510,375, 2,567,348, 2,673,668, and 6,722,538, the crossbar is held somewhat rigid by engaging the crossbar with the mobile spar segments with a pawl or lug on a rack. A further shortcoming of sliding-frame hangers is that each side needs to be extended independently, making it inconveniently difficult to extend them equally to fit a garment, except when fully extended. In fact, in the asymmetrical sliding-frame hangers disclosed in U.S. Pat. No. 7,246,729, awarded to Kevin A. Harvey in July 2007, the fully extended configuration is the only position at which the spars are equal in length. On the other hand, non-sliding garment hangers are not adjustable in width anyway. U.S. Pat. No. 2,496,561, awarded in February 1950 to Jack A. Saunders, solves this problem by coordinating the spars' positions with a split pull-chain. A major inconvenience of sliding-frame hangers is that in order to extend the spars, one needs to either reach blindly inside the garment to find their ends and pull them out, or grope blindly through the fabric of the garment from the outside to find their ends and pull them out without damaging the garment. In a few inventions in which the spars cross over, including U.S. Pat. No. 2,452,346, awarded to Joseph F. Appleman in October 1958, as well as U.S. Pat. Nos. 2,477,873, 2,487,445, 2,738,908, 5,456,391, 5,511,701, 5,664,710, 5,975,385, 6,409,058, 6,644,520, the telescoping spars are extended mechanically, by rotating the suspensor or a separate crank or knob, on whose shaft is mounted a pinion which simultaneously engages a rack embedded in each spar, thus extending or retracting the spars in synchrony; whereas U.S. Pat. Nos. 2,494,272 and 5,102,019 achieve the same effect with two one-sided telescoping spars, each of whose distal segments either contains an embedded rack driven by a worm gear or a pulley driven by a belt. All these methods both the problem of extending the spars equally and the problem of having to reach inside the garment to contract or extend the spars. When used for open top-wear garments, a further problem with telescoping frames could conceivably arise in that the weight of the garment might overcome the friction in the telescoping joints and pull the sliding members out further than desired, distorting the shape of the garment. Some sliding-frame hangers, including U.S. Pat. Nos. 0,320,230, 0,395,884, 0,904,249, 2,364,931, 2,504,562, 2,524,612, 2,525,142, 2,619,269, 2,620,102 (e.g., FIG. 1), 5,344,054, solve this problem by securing the telescoping segments with set-screws, while other inventions, including U.S. Pat. Nos. 0,890,271, 2,699,276, 6,637,630, secure them with pins or rivets fitting through holes aligned with a rack. Other inventions, including U.S. Pat. Nos. 0,847,212, 0,912,047, 1,377,836, 1,422,782, 2,283,530, 2,335,285, 2,409,708, 2,421,433, 2,446,312, 2,491,836, 2,494,711, 2,538,971, 2,582,669, 2,589,374, 2,620,102 (e.g., FIG. 6), 2,637,471, 2,652,958, 2,666,561, 2,679,958, 2,701,083, 2,709,026, 2,716,512, 2,722,351, 2,754,039, 2,814,426, 2,817,471, 2,900,117, 3,039,662, 4,717,053, 4,895,283, 4,905,877, 5,082,152, 5,085,358, 5,145,098, 5,613,627, 6,722,538, 5,718,358, 5,718,362, 5,727,718, 5,941,429, 6,021,932, 6,062,445, 6,206,255, and 6,688,503, secure the mobile segments to the fixed segments with pinions, pawls, lugs, or detents engaging racks.

In one particularly innovative sliding-frame garment hanger invention, disclosed in U.S. Pat. No. 2,352,264, awarded in June 1944 to Osborne L. Horton, the spars do not slide alongside one another, but rather across each other, one through the other. Thus, this design puts no restrictions on the shape of the spars. To address the problem of torque imbalance, this invention braces the upper ends against each other, each forming one side of the suspensor hook, thus effectively forming a crossbar above rather than below the spars. Since the upper end of each spar extends all the way to the suspensor, this invention permits the hanger to be inserted or extracted through the neck of a garment without reaching one's hands inside the garment. However, since the suspensor hook is formed and closed precisely by extending the hanger, hanging a garment on a clothes-rod with this hanger would require at least three hands. Moreover, because the second spar is inserted through the first from above, this hanger requires an often inconvenient amount of space above the clothes-rod for clearance.

Flexible-Frame Hangers

A few garment hanger inventions feature a frame whose size can be adjusted by flexure. One trouble with all such designs is that heavy garments may flex the frame in undesirable ways. Two such inventions, U.S. Pat. No. 1,352,382, awarded in September 1920 to David R. Riddick, and U.S. Pat. No. 2,507,906, construct tensile spars out of elastically coiled spring prone to pinch and unravel the garment fabric, and for lateral stiffness rely on an extensible crossbar likely to crumple under a heavy garment—a two-segment telescoping rod fastened with a setscrew in U.S. Pat. No. 1,352,382, and a folding lattice with 22 levers and 34 pivots held in position by friction in U.S. Pat. No. 2,507,906. Both of these would require reaching into the garments with both hands to extend the frame, and the first also to contract the frame.

Two other flexible-frame hanger inventions, U.S. Pat. No. 6,073,819, disclosed in June 2000 by Kathleen A. Wing, and U.S. Pat. No. 6,328,186, employ spars with a soft flexible covering and a core which is stiff in the central region of the frame and workably pliable in the peripheral region, bent to shape by hand.

U.S. Pat. No. 5,711,464, awarded in January 1998 to Raymond Huang, uses a tensile crossbar with a ring at each end to adjust the size and shape of a flexible spar by hooking the rings into different notches on the spar. However, passing the hanger frame through a narrow garment neck would entail attaching or adjusting the crossbar inside the garment.

U.S. Pat. No. 5,826,759, awarded in October 1998 to Yasuhiro Ohsugi, the resilient spars extend outward frame a crosspiece and loop back through the crosspiece from below, terminating in the suspensor hook, whereby the size of the loops can be adjusted by feeding the material through the crosspiece, so that the frame can be passed through a narrow garment neck simply by pulling the suspensor and crosspiece apart to shrink the frame. Unfortunately, this operation requires two hands, leaving none free to hold the garment.

In a couple of other designs, including U.S. Pat. No. 4,981,242, awarded in January 1991 to Robert D. Grahm, as well as U.S. Pat. No. 5,022,570, the spars are formed of pliant material. Both feature a slender core of stiff but deformable material, surrounded with a thicker stretchy padding. In principle, the frame of such a hanger could be inserted through a narrow garment neck by first bending both arms downward, and then grabbing through the garment fabric to reshape them, but the rough handling of the garment this necessitates would risk soiling, wrinkling, wearing, and tearing the garment fabric.

Removable-Suspensor Hangers

Several garment-hanger inventions feature a removable suspensor hook. In principle, this makes it possible to first insert the hanger frame through a narrow garment neck, and then attach the suspensor; or to first detach the suspensor and then remove the frame through the garment neck, although no removable-suspensor hangers appear to have been designed with this purpose in mind. All such inventions present the risk of inadvertently dropping or losing one part or the other, which is particularly vexatious if the frame lodges somewhere inside a long garment. Most also present the danger of damaging the garment's fabric with the detachable end of the suspensor. And all of them require fine-motor skills incommensurate with the gross task of hanging a garment, and an acuity of vision incompatible with the darkness in typical closets. In most of the removable-suspensor clothes hanger inventions, including U.S. Pat. No. 0,765,331, awarded in July 1904 to John Thomas Batts, as well as U.S. Pat. Nos. 1,108,848, 1,268,881, 1,374,024, 2,354,099, 2,519,276, 2,895,657, 3,587,949, 3,703,978, and 4,750,651, the suspensor is hooked onto the frame, held in place by a hook or head. In a few, including U.S. Pat. No. 0,851,527, awarded in April 1907 to Joseph Kronacher, as well as U.S. Pat. Nos. 0,904,249, 1,734,549, 1,886,298, 2,548,810, and 4,669,642, it is screwed in.

In U.S. Pat. No. 5,074,446 (e.g., FIG. 1), awarded in December 1991 to James N. Suddath, the suspensor is attached to the frame by simply inserting stubs at the base of the hook into the hollow arms of a one-piece plastic frame, and is held in place only by the resilience of the frame, with the unfortunate consequence that the assembly would fall apart under the weight of a heavy garment or from a sudden movement.

In U.S. Pat. No. 1,550,634. awarded in August 1925 to Antti Polkko, the suspensor is secured to the bottom of the frame with a head and to the top of the frame with a threaded nut. Perhaps the most laborious is that of Elisabeth Müller, described in U.S. Pat. No. 1,809,561, June 1931, which requires a flexible suspensor to be threaded through the frame and knotted. In contrast, the simplest to attach is snapped in, as described by Michel S. Schwartz & William Blasnik in U.S. Pat. No. 3,963,154, awarded in June 1975, and later in U.S. Pat. No. 4,074,838; although detaching the hook by pinching the expanding snap flanges is probably much more difficult.

Folding-Suspensor Hangers

Many garment-hanger inventions collapse the garment suspensor by folding the suspensor down toward the frame. All such inventions share some important shortcomings. Although folding the suspensor out of the way permits the entire hanger to be inserted in its collapsed state through the neck of a garment, subsequently maneuvering the hanger around inside the garment to bring the suspensor to the neck opening so that the suspensor can be folded back out is awkward and entails either reaching one's hand into the garment or groping for the hanger through the garment fabric. Likewise, in order to remove the hanger from the garment, after folding the suspensor out of the way, one must awkwardly manipulate the hanger into position for removal through the neck by either reaching into the garment with one's hand or grasping the hanger through the fabric of the garment. A further drawback of folding-suspensor hangers is that the garment cannot be hung or unhung in place, while the hanger is suspended by its suspensor. Still another drawback of many folding-suspensor garment hangers is that the suspensor element does not remain erect on its own, making it difficult to hang up or take down the hanger, as one must somehow support the weight of the garment while firmly grasping the suspensor, an action which is not merely awkward but presents the risk of pinching one's skin or fingers between the suspensor hook and the clothes rod or other hanging purchase. Furthermore, many folding-suspensor garment hangers present the danger of pinching one's skin or the garment fabric in the folding mechanism, albeit under less leverage than in folding-frame garment hangers. And in its inverted position, the large suspensor hook is apt to snag on the threads and seams inside the garment as the hanger is maneuvered back and forth.

In a large number of folding-suspensor garment hangers, as in U.S. Pat. No. 0,640,616, issued in January 1900 to John F. Brock, as well as U.S. Pat. Nos. 0,665,314, 0,838,839, 0,847,212, 0,890,023, 1,005,967, 1,040,942, 1,207,338, 1,286,022, 1,356,448, 1,696,480, 1,836,935, 1,970,943, 1,979,687, 2,425,475, 2,507,906, 2,531,108, 2,544,170, 2,582,669, 2,595,026, 2,633,276, 2,724,533, 2,777,619, 2,781,157, 3,254,814, 3,315,854, 3,443,729, 3,802,610, 3,802,611, 4,915,271, 5,044,534, 5,649,652, 6,000,587, and 7,021,507, the suspensor is designed to pivot out of the way within the plane of the hanger frame toward one spar or the other. This asymmetry proves inconvenient after inserting the hanger through the garment neck opening, when the center of the hanger must be aligned to the correct edge of the neck opening in order to reerect the suspensor. In a few in-plane folding-suspensor hangers, such as U.S. Pat. Nos. 0,668,673, 0,881,818, 1,058,394, 1,184,743, 1,248,577, 1,385,449, 1,453,000, and 2,745,579, the suspensor can only be folded down in one direction, making collapsing the hanger inconvenient as well. Many in-plane folding-suspensor hangers, including U.S. Pat. No. 0,624,415, issued in May 1899 to Franz Weber, as well as U.S. Pat. Nos. 0,713,376, 0,886,041, 0,892,149, 0,920,240, 0,912,047, 0,932,756, 0,976,531, 1,101,088, 1,114,294, 1,268,881, 1,336,375, 1,351,516, 1,370,713, 1,399,115, 1,415,747, 1,444,525, 1,458,113, 1,458,114, 1,521,972, 1,577,290, 1,673,059, 1,682,626, 2,096,827, 2,108,622, 2,448,234, 2,605,942, 2,701,082, 3,334,793, 3,451,601, 3,645,426, 3,726,452, 3,790,046, 3,834,598, 3,874,572, 4,186,857, 6,244,479, 6,311,880, 6,328,187, 6,345,742, and 6,431,419, solve this problem by permitting the suspensor to rotate full circle in either direction, but at the expense of having to reach one's hand further in through the neck opening of the garment in order to retrieve the suspensor after inserting the hanger. Two folding-suspensor hangers approach this problem instead by having the suspensor fold more-or-less straight downward in the plane of the hanger frame, being hinged on both sides. In the first, disclosed in U.S. Pat. No. 2,513,980 in July 1950 by Harold Kuss Widmann, the change in height of the suspensor is ancillary to the purpose of adjusting the width of the frame via the laborious manipulation of turnbuckle on the crossbar; In the other, disclosed by Peter Ar-Fu Lam in U.S. Pat. No. 5,727,718 (e.g., FIG. 8) in March 1998 (and again in U.S. Pat. No. 6,021,932 (e.g., FIG. 8)), the suspensor is doubly hinged on each side, relying on the flexibility of the plastic frame to accommodate the intermediate widening of the upper rail, but this four-hinge design entails a considerable structural weakening, instability, and susceptibility to mechanical failure. In a few in-plane folding-suspensor hangers, as in U.S. Pat. Nos. 2,558,583 and 2,613,858, the suspensor hook itself is jointed, permitting it to folded together to collapse it into a still-smaller volume, but at the expense of a substantial weakening of the suspensor, as well as increased cost of manufacture. A further drawback of in-plane folding-suspensor hangers is that the pivot between the suspensor and the frame is down near the center of gravity, making increasing the susceptibility of the hanger to rocking in the plane of the hanger and thus of the garment to shift toward the lower end, whereupon the imbalance causes the hanger to tilt ever further until it dumps a wider-necked or open garment on the floor. The problem is perhaps less severe in those designs which only permit the suspensor to rotate to one side. U.S. Pat. No. 2,096,827, awarded in February 1937 to Frank Simon, as well as U.S. Pat. No. 3,334,793, solve the problem by permitting the suspensor to be cumbersomely aligned in the erect position and clamped in place with a wingnut, which is easily lost along with its accompanying washer. U.S. Pat. No. 2,582,669, still more cumbersomely, uses a bolt and nut. A couple of patented designs, including U.S. Pat. No. 3,451,601, awarded in June 1969 to Joseph Pelavin and Frank Ioviero, and U.S. Pat. No. 3,726,452, feature a double-ended suspensor, with a large hook at one end for conventional clothes rods, and a small hook at the other for use in luggage, provide a catch to lock the small hook in position, but not, curiously, the large hook. U.S. Pat. No. 3,790,046, awarded in February 1974, uses a catch to hold the hook in the erect position.

In many folding-suspensor hangers, the suspensor is designed to pivot out of the way perpendicularly to the plane of the garment hanger frame, as in U.S. Pat. No. 0,554,643, awarded in February 1896 to Charles Behrend, Jr., as well as in U.S. Pat. Nos. 0,765,331, 0,787,622, 0855295, 0,996,504, 1,017,854, 1,049,867, 1,114,002, 1,181,691, 1,184,700, 1,570,196, 1,598,747, 1,638,844, 1,970,943, 2,164,208, 2,170,319, 2,301,814, 2,413,221, 2,428,820, 2,491,836, 2,562,368, 2,663,470, 2,719,658, 3,131,817, 3,214,071, 3,860,154, 3,870,206, 4,168,791, 4,750,651, 4,932,571, 5,085,357, 5,145,098, 5,727,718, 6,021,932, and 6,076,716. Garment hangers with perpendicularly folding suspensors suffer a greater risk of overstretching the garment neck, since the unfolding suspensor takes up more room in it perpendicular state as it rotates out of the plane of the hanger frame.

In a few folding-suspensor hangers, the suspensor is free to pivot in any direction, as in U.S. Pat. No. 0,364,803. awarded in June 1887 to Hans Christian, as well as U.S. Pat. Nos. 2,137,700, 2,547,436, 2,682,978, 2,808,187, 3,703,978, 4,624,396, and 7,021,507 (e.g., FIG. 5). In such hangers, it is difficult to prevent the suspensor hook from flopping around and snagging on the garment threads or seams in the process of maneuvering the hanger around inside the garment.

Sliding-Suspensor Hangers

Several prior garment-hanger designs feature a slidingly extensible suspensor. In theory, retracting the suspensor hook could make it possible to insert or remove the entire frame of the hanger through a narrow neck opening without stretching, tearing, or unfastening the garment or snagging the suspensor hook on the garment collar; However, no retractable-suspensor clothes hangers appear to have been invented with this purpose in mind, although in U.S. Pat. No. 4,063,670, awarded in December 1977 to Jens Faarbech, the hook is designed to be completely retractable for the related purpose of avoiding snagging it on adjacent clothing or hangers when removing the hanger from a clothes rod. Indeed, only in a few such inventions, including U.S. Pat. No. 0,975,509, patented by Joseph E. Carroll in November 1910, as well as U.S. Pat. Nos. 2,425,527, 3,802,611, and 4,063,670, is the suspensor sufficiently retractable to prevent snagging the clothing. All of these inconveniently require delicately fishing out the suspensor with the fingertips prior to use, and in order to lift the suspensor over a clothes rod or other support to hang up or take down the hanger, one has to grasp the hanger by its suspensor, and either bear the entire weight of the hanger and garment with that frail grip, or reach into the wardrobe to support the garment with the other hand. Moreover, in most of these designs, the hook retracts into a collar support which obstructs easy passage of the hanger through a garment neck. In U.S. Pat. No. 2,425,527, awarded in August 1947 to Orlando Alboeno Gaudino, the suspensor also retracts into a taller central frame section, but one whose top curves smoothly into the tops of the adjacent folding spars. Nevertheless, all of these designs would require reaching through the garment neck after inserting the hanger therethrough, in order to manipulate the center of the hanger back to the neck opening.

Several inventions featuring a retractable suspensor overcome this problem by attaching the suspensor to the frame in such a way that retracting the suspensor folds the spars downwards to horizontally collapse the frame so that it can fit straight through the neck; whereas extending the suspensor lifts the spars to extend the frame horizontally to support the garment shoulders. These include U.S. Pat. No. 0,958,366, awarded to Edgar C. Clausen in May 1910, as well as U.S. Pat. Nos. 0,959,687, 1,111,147, 1,676,936, 1,886,869, 2,290,722, 2,629,525, 2,881,965, 3,858,770, and 4,227,632 (e.g., FIGS. 7,8). However, all such designs suffer from the problems of structural weakness and mechanical failure explicated earlier in the discussion of downward-folding spars.

In two nearly identical century-old prior garment-hanger inventions, the suspensor is free to slide along the frame in the collapsed frame configuration. In principle, this could make it possible to insert the hanger frame through a narrow neck and then extend the frame inside the garment, and to collapse the frame inside the garment and then extract it through a narrow neck, all the while holding the suspensor outside. Both feature recurved wire spars telescoping into each other. In the first, disclosed in U.S. Pat. No. 0,640,616 by John F. Brock in January 1900, an eye at the root of the wire suspensor is attached to a link which straddles three of the wire spar ends. In the second, disclosed in U.S. Pat. No. 0,668,673 by Simeon S. Brooks in February 1901, the bottom of the suspensor is forked, with an eye at the end of each tine, and attached thereby to both ends of one of the wire spars. These hangers can easily be removed through a narrow-necked garment by propping one shoulder of the garment against one's chest and pressing the other garment shoulder towards one's chest with one hand to collapse the frame inside the garment while holding the suspensor in the other hand. However, extending the hanger inside the hanger requires reaching inside with both hands to pull the ends apart, thus obviating any advantage that retaining the suspensor outside might afford. Moreover, both these designs are exceptionally flimsy, with the spars overlapping hardly at all in their extended configuration.

Limp-Suspensor Hangers

In several garment hanger inventions, including U.S. Pat. No. 839,843, awarded in January 1907 to John H. Herbener, as well as U.S. Pat. Nos. 964,072, 976,094, 1,018,584, 1,114,294, 1,377,836, 1,377,837, 1,809,561, and 1,836,942, the suspensor is limp, and droops when let go, easily permitting the hanger frame to fit through a narrow garment neck. The chief problem presented by this feature is that, after inserting the hanger through the garment neck, the hanger first has to be manipulated into position to bring the center back under the neck opening, and then the limp suspensor has to be fished out.

As all of these inventions precede the widespread availability of clothes rods, the suspensor in a majority is merely a chain of metal links, both of whose ends are attached to the hanger frame, as in U.S. Pat. No. 1,114,294, awarded in October 1914 to J. Routstone. Most of these include a sturdy ring at the apex for hanging on a hook or nail, as in U.S. Pat. Nos. 839,843, 1,018,584, 1,377,836, 1,377,837. A few do substitute a small metal hook for the central ring, including U.S. Pat. No. 964,072, awarded in July 1910 to Samuel T. Watanabe, as well as U.S. Pat. Nos. 967,094 and 1,836,942, but in these the hook is liable to become entangled in the frame, making it all the more difficult to fish out of the garment. Worse, the hook is apt to snag or tear the garment.

Two prior inventions, U.S. Pat. Nos. 1,809,561 and 1,836,942, use a string instead of a chain, and are thus more prone to wear and tear. In U.S. Pat. No. 1,809,561, awarded in June 1931 to Elisabeth Müller, only one end of the string is attached to the frame, requiring the free end to be tied around a support.

In a couple of designs, U.S. Pat. Nos. 965,072 and 1,809,561, only one end of the limp suspensor is connected to the frame, permitting the hanger frame to pivot about this connection, which, being down close to the center of gravity, makes the hanger especially susceptible to a rocking motion that can cause the garment to shift toward the lower end of the frame, causing it to list ever further over until a wider-necked garment slips off the hanger and falls to the floor. Even some of the limp-suspensor designs in which both ends of the chain are attached to the frame suffer from this problem, because they have slidingly extensible frames which permit the ends of the chain to slide together, as in U.S. Pat. Nos. 976,094, 1,018,584, 1,377,836, and 1,377,837.

Inflatable Hangers

A few patents, including U.S. Pat. Nos. 1,734,549, 2,622,774, 2,813,667, and 3,923,212, teach the construction of pneumatic garment hangers in which one or more balloons are inflated with air to achieve sufficient turgor to support a garment, and deflated to take up less space when not in use. Though not specifically intended for the purpose of facilitating insertion through a garment neck opening, in their deflated state such hangers could certainly fit through a narrow garment neck. In principle, however, pneumatic garment hangers suffer from several problems. In its deflated state, a balloon is too flaccid to push through a garment neck opening, and would need to be pulled through instead. Holding a flaccid balloon in place while also holding the garment and inflating the balloon by mouth would be awkward. Under turgid pressure sufficient to support a heavy garment for months or years at a time, balloons' films, seams, and valves tend to leak. In a retail setting where clothing is often pinned with straight pins for display, the balloons would be at constant risk of puncturing and popping. Users lacking the thoracic capacity to inflate the hangers themselves would require a servant or air compressor to inflate them. Hangers orally inflated by multiple users would present an unacceptable hygienic risk of transmitting tuberculosis, influenza, and other orally transmitted diseases.

Asymmetrically Cantilevered Hangers

In several patented garment hanger inventions, including U.S. Pat. Nos. 2,164,420, 2,232,028, 2,412,735, 2,499,538, 3,485,423, 5,649,653, 5,806,727, 6,036,062, 6,230,945, 6,260,746, and 6,315,176, the suspensor hook is attached off-center, via a strut connected to only one end of the hanger frame, to leave an open slot between that strut and the frame. This slot serves to admit the collar and shoulder of one side of the garment as the free end of the hanger frame is tucked into the sleeve on that side until the attached end of the frame clears the inside of the collar on the opposite side, thus permitting the attached end of the hanger to be inserted or removed through the garment neck opening. While elegant in their simplicity, such inventions have serious drawbacks. The one-sided attachment of the suspensor substantially increases the cantilevered length of the frame—up to approximately 6 times the length in the model depicted in FIG. 4 in U.S. Pat. No. 2,232,028—thus greatly weakening the frame, and requiring substantial vertical structural reinforcement to support a heavy garment. This effect is magnified by the non-barycentric attachment of the suspensor, such that the weight of a garment on the free end of the hanger applies an unbalanced torque with a large moment at the attached end of the frame. The excessive cantilevered length also weakens the hanger horizontally, so that it would tend to wobble laterally without substantial lateral reinforcement. Moreover, the asymmetrical support would cause the free end of the hanger to sag, so that garments would tend to slide and droop toward or even off that end, resulting in asymmetrical puckers and wrinkles. A few inventions, including U.S. Pat. Nos. 2,595,442 and 4,004,721, as well as some of the inventions in U.S. Pat. Nos. 2,232,028, 6,036,062, and 6,230,945, seek to moderate these structural weaknesses by providing a means to attach the free end of the hanger frame for hanging and detach it for insertion and extraction, but the joint between the free and rigidly attached ends of the frame in such inventions is still a weak point, and in practice, fumbling for the free end and reattaching it, particularly when the hanger is bent out of shape under the load of a heavy garment, would be inconvenient. Also inconvenient is the intrinsic asymmetry of the hanger during manipulation, due to the eccentric hook attachment, so that it can only be inserted into or extracted from the garment in one direction. Furthermore, the one-sided joint between the suspensor hook and the hanger frame would be too weak, without major reinforcement, to support a swivel hook—although one invention, described in U.S. Pat. No. 6,260,746, proposes just that—a further inconvenience, as the garmented hanger must be oriented properly to engage the suspensor hook on the clothes-hanging rod.

U.S. Pat. No. 7,246,729, assigned to Kevin A. & Robin J. Harvey, proposes to collapse a hanger gravitationally or manually such that one spar nests inside the other, both presumably of the same fixed curvature, the outer hollow spar attached to the suspensor hook. By tilting the hanger in the appropriate direction, the inner spar is supposed to fall into or out of the outer spar, overcoming the dashpot effect, the internal friction between the nested spars, or manually, by pulling out on the exposed end of the sliding spar after insertion and pushing it back in prior to removal.

What is needed is a general-purpose garment-hanging apparatus and method which is especially useful for narrow-necked garments.

BRIEF SUMMARY OF THE INVENTION

Disclosed is an apparatus and method including an apparatus and method for hanging narrow-necked garments. The following summary of the invention is provided to facilitate an understanding of some of technical features related to sliding carriage garment hangers, particularly to hanger systems and methods conforming generally to traditional hanger systems and methods except for the improvements and enhancements described herein, and is not intended to be a full description of the present invention. A full appreciation of the various aspects of the invention can be gained by taking the entire specification, claims, drawings, and abstract as a whole.

A hanger assembly for a garment including a neck opening and a pair of shoulder areas, including: a frame having a pair of lateral ends, each lateral end configured to support one shoulder area of the pair of shoulder areas from inside the garment; and a suspensor, coupled to the frame to transition between a pair of locations along the frame with the pair of locations including a first location generally centered between the pair of ends and a second location closer to a particular lateral end than an other lateral end, the suspensor having a suspending mode wherein the suspensor is located at the first location and an insertion-removal mode in which the suspensor is located at the second location.

A hanging method for a garment including a neck opening and a pair of shoulder areas, the method including: a) moving a first lateral end of a pair of shoulder area-supporting lateral ends of a frame of a garment hanger relative to a suspensor moveably coupled to the frame, to transition the suspensor towards a second lateral end of the pair of lateral ends; b) inserting the first lateral end through the neck opening towards a first shoulder area of the pair of shoulder areas; c) inserting the second lateral end through the neck opening towards a second shoulder area of the pair of shoulder areas; and thereafter d) moving the suspensor along the frame to a centered location generally equidistant between the pair of lateral ends; wherein a distance between the suspensor and the first lateral end when the suspensor is moved to the centered location is greater than a width of the neck opening.

Embodiments of the present invention include a general-purpose garment-hanging apparatus which is especially useful for narrow-necked garments, and preferably include a sliding-carriage garment hanger in which the suspensor element is attached to a carriage which is separate from the frame and glides along the frame. When the hanger is supporting garments during normal use, a stop at the center of the frame holds the carriage in place at the frame's balance point. When not in use, the carriage rests at the check near either end of the frame, where a stop holds the carriage in place. To hang a narrow-necked garment, with the carriage is grasped in one hand or suspended from a clothes rod or other support, the operator grasps one shoulder of the garment in the other hand, inserts the extended end of the frame through the neck opening and under that shoulder and into the sleeve on that side of the garment, tucks the stub of the retracted end of the frame under the opposite shoulder of the garment, and pushes on the extended end of the frame or the sleeve covering it to return the carriage to the center of the frame. In reverse fashion, to remove a narrow-necked garment from the hanger, with the carriage grasped in one hand or suspended from a clothes rod or other support, the operator uses the other hand to push one end of the frame into the carriage to the check on that end of the frame, extracts the remaining stub on that end through the neck opening, and pulls the extended end of the frame out through the neck opening. Preferred embodiments of the present invention make it easy for a person to hang or unhang a garment with one hand while the hanger is suspended from the other hand or a clothes rod, without reaching inside, unfastening, stretching, or tearing the garment.

A check near either end of the frame prevents the carriage from sliding off the frame. In the preferred embodiment, the checks are unidirectional, permitting the carriage to be mounted on the frame during assembly. Optional features such a swivel hook, a branding escutcheon, collar supports, non-slip shoulder supports, strap holders, skirt-loop holders, a crossbar and clamps, cambered and stubbed shoulder supports, a ganging link, together with dimensions and shapes closely matching those of many standard clothes hangers, make the hanger useful as a general-purpose garment hanger otherwise interchangeable with existing hangers. The parts can be manufactured of a variety of inexpensive materials, including plastic, metal, wire, and wood, and easily assembled by snapping them together.

The most-preferred embodiment matches the style of the plastic garment hangers currently popular in clothing department stores, with a wire swivel hook, an injection-molded plastic I-beam rail, and a carriage likewise manufactured of injection-molded plastic, with typical optional accessories such as a ganging link beneath the carriage; strap holders in the top of the rail; skirt-loop holders in the bottom of the rail; a cambered and stubbed top flange on the rail to minimize misshaping of the garment shoulders; a non-slip texture on the top of the rail; and a crossbar and clamps beneath the rail for hanging skirts and slacks.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a general-purpose garment-hanging apparatus and method which is especially useful for narrow-necked garments. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figures 1, 2, 3:
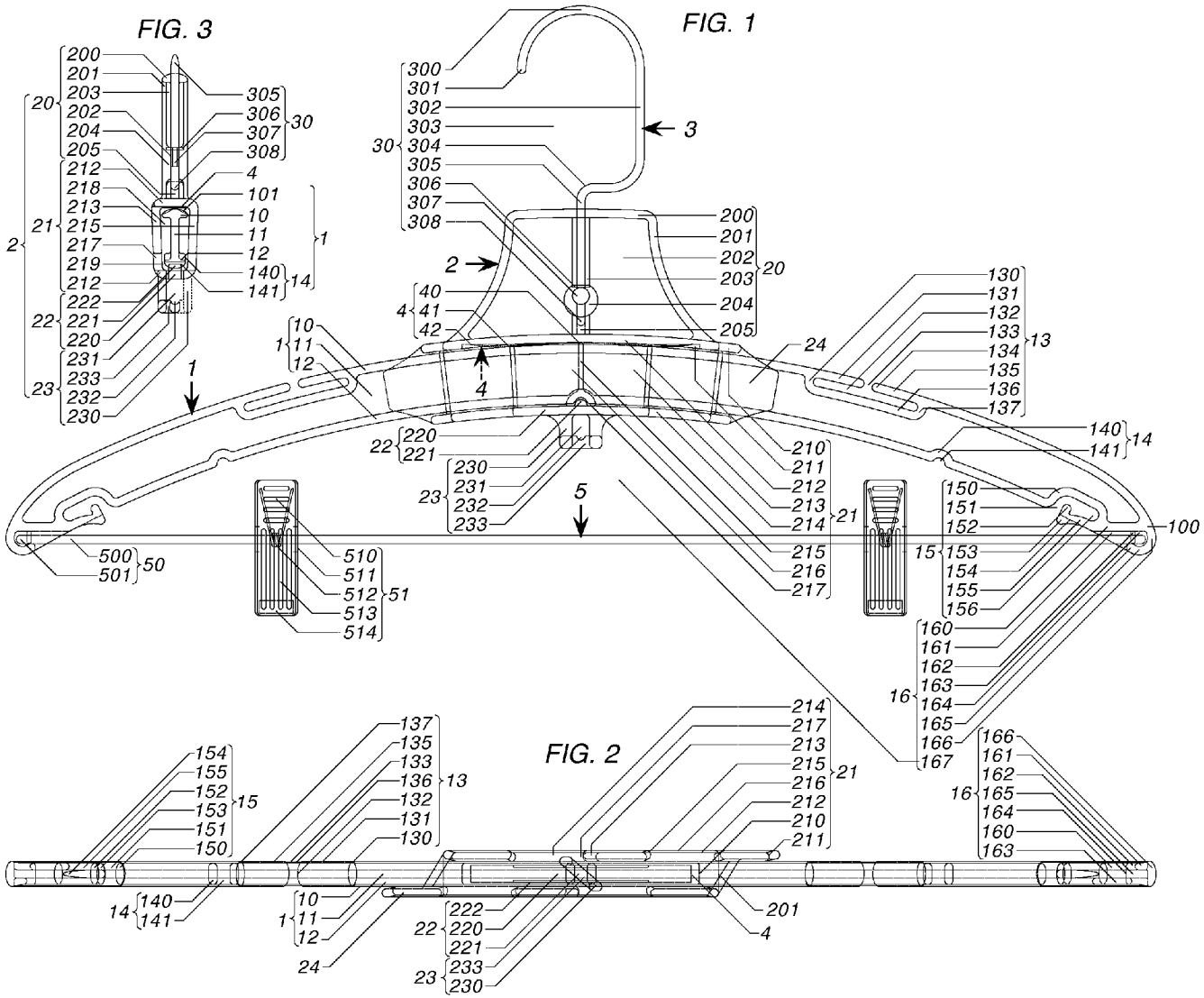
FIG. 1 illustrates an elevation view of an embodiment of the invention using inexpensive plastic I-frame construction, with the whole rail gliding through the carriage.
FIG. 2 illustrates a bottom view of an embodiment of the invention from FIG. 1 without the crossbar.
FIG. 3 illustrates a central cross-section view of an embodiment of the invention from FIG. 1 without the crossbar.

As indicated by the numbered arrows in elevation views FIG. 1,4 the embodiments may include five principal parts: arched rail 1 extending the full length of the hanger and designed to support the shoulders of a top garment; carriage 2 designed to slide along the rail during operation and to support the rail during use; suspensor 3 attached to the carriage and supporting the carriage during use, for example from a clothes rod; optional spring 4 lifting the carriage above the rail to actively engage the catch on the carriage with the stops along the rail; and optional crossbar 5 designed to support slacks or other clothing draped over the crossbar or a garment such as slacks or a skirt gripped by clamps riding on the crossbar. The suspensor and carriage may optionally be manufactured of a single piece.

Figure 7:
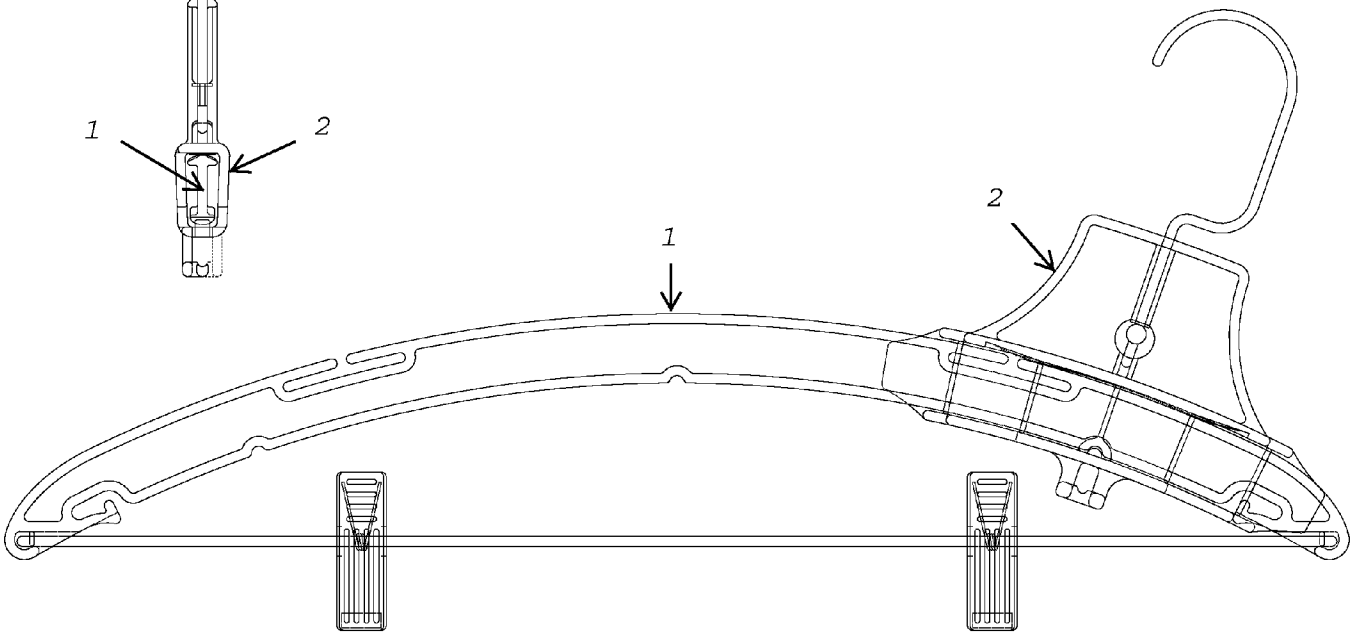
FIG. 7 illustrates the embodiment of FIG. 1 transitioned to an insertion-removal mode from a suspension mode with the carriage slid to one lateral end of the frame.
Figure 8:
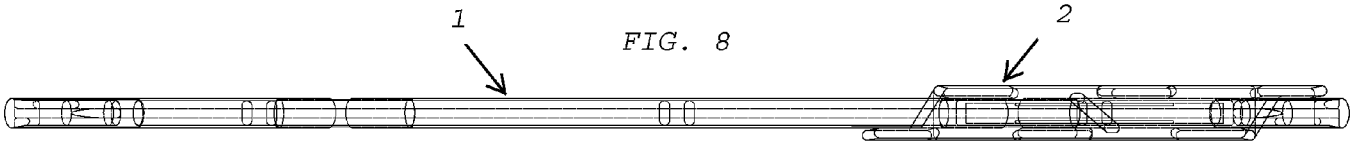
FIG. 8 illustrates a bottom view of the FIG. 7 configuration.

FIG. 7 illustrates the embodiment of FIG. 1 transitioned to an insertion-removal mode from a suspension mode with the carriage slid to one lateral end of the frame. FIG. 8 illustrates a bottom view of the FIG. 7 configuration.

Figure 9:
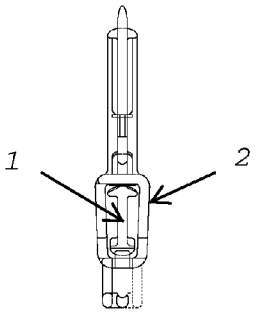
FIG. 9 illustrates a central cross-sectional view of FIG. 7.
Figure 10:
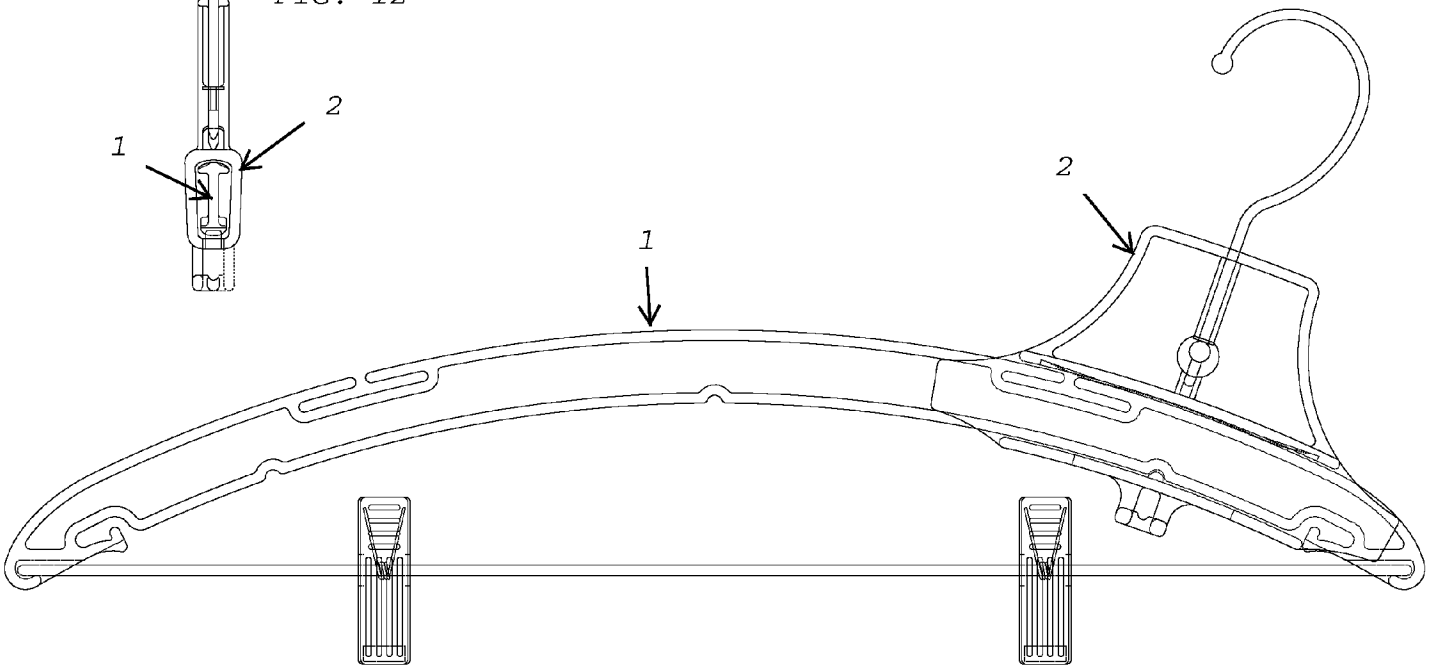
FIG. 10 illustrates the embodiment of FIG. 4 transitioned to an insertion-removal mode from a suspension mode with the carriage slid to one lateral end of the frame.
Figure 11:
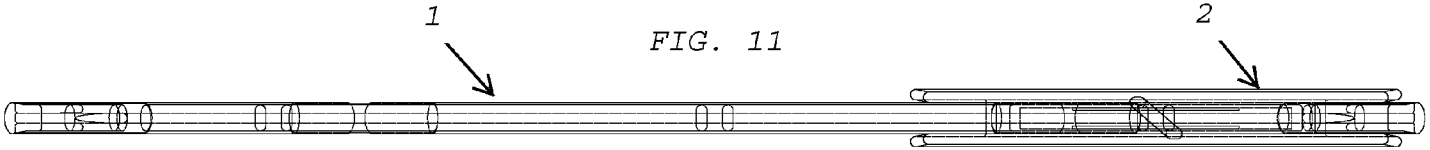
FIG. 11 illustrates a bottom view of the FIG. 10 configuration.
Figure 12:
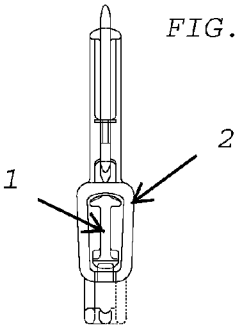
FIG. 12 illustrates a central cross-sectional view of FIG. 10.

FIG. 9 illustrates a central cross-sectional view of FIG. 7. FIG. 10 illustrates the embodiment of FIG. 4 transitioned to an insertion-removal mode from a suspension mode with the carriage slid to one lateral end of the frame. FIG. 11 illustrates a bottom view of the FIG. 10 configuration.

Rail 1 may be fashioned of plastic, as shown here, or of wood, metal, or any materials of suitable strength and stiffness to support the weight of heavy garments. In the extended position, the protracted end of the rail, which needs to be able to briefly support the entire garment during operation, is cantilevered out nearly twice as far as in the balanced position, so the rail is accordingly designed to be correspondingly stronger than in a non-sliding hanger. In the preferred embodiment, the rail is rotationally symmetrical in form about the vertical axis in order to avoid the inconvenience of having to turn it or the clothing around when hanging a garment, and in order to permit the same mold shape or shaping process to be used for both faces of the rail. In the preferred embodiment, as shown here, the envelope of the rail has uniform curvature throughout the carriage's operational longitudinal range of travel, to let carriage 2 slide freely along the rail. In an alternative embodiment (not shown), a tighter curvature toward the periphery, for example to permit the ends of the rail to swoop downward to further reduce deformation of the garment shoulders and to leave more handroom 167 when draping slacks or other clothing over crossbar 5, is accommodated by raising the center of carriage roof 212 and hence increasing the height of channel 218 (e.g., FIG. 3) at the center to allow the carriage to be maneuvered around tighter corners, and by omitting strap holders 13 to prevent strap-holder prongs 131, 135 from snagging the carriage or garment shoulders.

Rail 1 as depicted here is in the basic cross-sectional form of an I-beam (FIG. 3), currently the most popular construction seen in major department stores, which forms a particularly stiff structure resisting flexure within the plane of the rail while using a minimum of material, and can be injection-molded with a single pair of molds. Alternatively, the cross-section of the rail may be tubular, solid, or any other shape of suitable strength and stiffness to support a garment. The I-beam structure consists of top flange 10, web 11, and bottom flange 12. The exterior convex edges of all flanges are smoothly chamfered or otherwise blunt to avoid damaging the garment or injuring the user, and are tapered to conserve material. The interior, concave edges are smoothly filleted or otherwise blunt to avoid collecting dust and facilitate cleaning.

Rail top 10 is preferably cambered above (FIG. 3) in cross-section to alleviate creasing or otherwise deforming the yoke or shoulder fabric of the garment. The rail top is made wide enough in cross-section to distribute the stress on the garment yoke or shoulders and lessen deformation of the garment fabric, yet narrow enough to permit dense packing of clothes. In the preferred embodiment, the camber of the upper surface of the rail top also ensures that only the ridge and sides of the top flange contact the relatively flat interior of carriage roof 212 and walls 213 (FIG. 3), both to reduce friction during operation and to leave a gap above flanks 101 (FIG. 3) of the rail top flange to admit application of an anti-slip texture such as ribbing, knurling, flocking, or adhesive to the top surface of the rail-top flanks to prevent wider-necked garments from sliding down the frame and unbalancing or capsizing the hanger and falling to the floor. In an alternative embodiment (FIG. 6), the camber of the interior of the roof of the carriage flushly matches the camber of the top of the rail, to prevent pinching fine knit fabrics in the interstitial gap.

At the ends of the frame, the curvature of rail top 10 preferably increases smoothly, forming descending stubs 100 to avoid puckering, wrinkling, or otherwise distorting the shape of garments whose yoke length does not correspond precisely to that of the hanger frame, a problem especially for wet or damp clothes hung up to dry.

Rail top 10 optionally features a pair of strap holders 13 for garments supported by straps, such as tank tops, halter tops, strapped gowns, and overalls, as well as necklaces and thin belts. In the preferred embodiment, the strap holders are placed symmetrically about the center of the frame to balance the load on the hanger, and to permit the same mold shape or shaping process to be used for each face of the rail, and are separated by the average distance between garment shoulder straps to avoid straining garments hung by their straps. Embodiments of the present invention makes it easier to hang or unhang a garment with closely spaced short shoulder straps, and makes it possible to hang or a unhang a garment with a short neck strap while the hanger is suspended from a clothes rod or other support. In addition, the inclusion of strap holders makes the hanger interchangeable with standard non-sliding multipurpose clothes hangers, and permits a sliding hanger at hand to be used for any garment. Each strap holder is lined with a rounded wide flange or other surface on floor 136 and ends 130, 137 to adequately support clothing straps and to maintain the rigidity and strength of the rail. Prongs 131, 135 reach over each strap holder, largely covering slot 132, both in order to properly support the shoulders of garments without sagging or deforming their fabric, and in order to avoid pinching the shoulder fabric between distal prong tips 134 and the lips 210 of the carriage. The tips of the prongs are blunt to avoid snagging or tearing the garment or catching the carriage lip or spring 4. Narrow gaps 133 between the prong tips conveniently admit wide garment straps into or out from wider slots beneath the prongs, and prevent the shoulder fabric from sagging into the slots. In the preferred embodiment, the prongs are paired to reach over equidistantly from either end of each strap hanger, so that proximal end flanges 130 and proximal prongs 131 prevent a single looped strap such as the neck strap of a halter top from slipping out of the strap holders toward the center of the hanger, while distal prongs 135 and distal end flanges 137 prevent paired shoulder straps from slipping out of the strap holders towards the ends of the rail. In an alternative embodiment (not shown), either the proximal prongs or the distal prongs are omitted. In another alternative embodiment (not shown), the rail 1 bears two separate pairs of strap holders, a proximal pair designed to hold neck straps, and a distal pair for shoulder straps.

In the preferred I-beam embodiment, rail bottom 12 is narrower (FIG. 2, 3) than rail top 10, both to conserve material and to wedge the rail into the downwardly tapered cross-section (FIG. 3) of the carriage during use to hold the rail more firmly in place and minimize rattling of the rail within the carriage.

In the preferred embodiment, rail bottom 12 bears three stops 14, each comprising a detent 141 preferably reinforced with a boss 140: one stop to hold the carriage in place at the central balance point during use, and one stop each to hold the carriage in place at either end while passing the frame through a narrow garment neck opening during operation. The stops may be placed anywhere around the cross-section of the rail, but in the preferred embodiment, as shown here, they are tucked underneath the rail out of the way of the clothing. The stops may take any suitable form, but in the preferred embodiment, as shown here, they take the form of rounded depressions, rather than protuberances, to keep the rail smooth and avoid catching the lips 210 of the carriage, snagging the garment, or roughing the user's hands; and so that only a single spring 220 for the catch is needed, rather than a separate spring for each detent. These depressions are sized wider than catch knob 221 in the carriage by at least the amount of lateral wiggle room 219 (FIG. 3) between rail 1 and carriage tube 21, in order to effectively seat the catch regardless of the lateral position of the carriage with respect to the rail. In the preferred embodiment, as shown here, the detents extend all the way across rail bottom so that they can be incorporated into the same two-piece mold used for the rail as a whole, and the stops are positioned symmetrically about the center of the rail so that the same mold shape or shaping process can be used for each face. In an alternative embodiment (not shown), the peripheral stops are omitted, and during operation the hanger relies on friction between the leading lower carriage lip and the bottom of the protracted end of the rail and between trailing upper carriage lip and rail top 10 of the retracted stub end of rail to prevent the carriage from prematurely sliding along the rail during insertion of the frame into a garment.

Rail bottom 12 optionally also bears a pair of skirt-loop holders 15 for garments such as skirts, pants, and pant-skirts fitted with loops inside the waistband or belt loops outside the waistband for hanging. Although some of the disclosed embodiment of the present invention may offer no particular advantage for hanging such garments, the skirt-loop holders are optionally included to permit the slide hanger to be used for any garment or ensemble of garments and to permit sliding and non-sliding clothes hangers to used interchangeably. Each skirt-loop holder is lined with a rounded wide flange or other surface 150 to avoid damaging the skirt loops or belt loops and to maintain the strength and rigidity of the rail. Prong 155 forming the floor of each skirt-loop holder supports the skirt loop during use, with a hook 152 at the free end to stretch out the skirt waist and prevent the skirt loops from slipping off toward the center. Gap 151 admits the skirt loop or belt loop into or out from slot 156 when hanging and removing the garment. In the preferred embodiment, the skirt-loop holders are placed symmetrically about the center of the frame to balance the load on the hanger and to permit the same mold shape or shaping process to be used for both faces of the rail, and are separated by the average hip distance between skirt loops to avoid straining the skirt-loop hangers or garments hung on them.

Each skirt-loop holder 15 also serves a second purpose as a check preventing the carriage from sliding off the rail, by means of spur 153 engaging carriage lip 210. The spur protrudes below the rail bottom, further than wiggle room 219 (FIG. 3) vertically between rail 1 and carriage 2, so that the carriage is checked regardless of the vertical position of the carriage with respect to the rail. While cantilevered prong 155 normally ramps downward to check the carriage from falling off, it is designed to flex upward in congruence with the arch of rail bottom 12 to permit the carriage to be mounted on the rail during assembly by sliding it on over the end of the rail. The skirt-loop prong is optionally fitted with groove 154 (FIG. 2) to permit catch knob 221 on the floor 214 of the carriage to pass under the hook during assembly without increasing the flexure of the hook. Note that even though the groove undercuts the bottom of the rail as seen from either face, it can nevertheless be incorporated into injection molds for the faces of the rail because the flexibility of the cantilevered prong lets it bend out of the way when the molds are removed perpendicularly from the faces of the rail. Checks 153 are set inward from the ends of the rail so that, when the carriage is stationed at the end of the rail in order to insert the extended end of the rail through the neck opening and under one shoulder of a garment, a stub 100 of the retracted end of the rail remains protruding in order to catch the opposite shoulder of the garment and be conveniently extended thereunder.

Rail bottom 12 also optionally features a pair of crossbar holders 16 to hold crossbar rod 50 over which garments such as slacks, scarves, and ties can be draped, or from which clothes such as skirts and half-slips can be hung by clamps 51 sliding along crossbar shaft 500. Crossbar holders 16 are located symmetrically about the center of the rail for levelness, and in the preferred embodiment their shapes are rotationally symmetrically related about the vertical axis to permit the mold for each face of the rail to have the same shape or in general for the same shaping process to be applied to each face. Although embodiments of the present invention may offer no particular advantage for hanging garments from a crossbar, crossbar holders are optionally included to permit an available slide hanger to be used for any garment or suit of garments and to permit sliding clothes hangers to used interchangeably with non-sliding clothes hangers. Floor 165 of the crossbar holder is preferably buttressed to adequately support the crossbar rod when weighted with clothing, and crossbar holder roof 160 is likewise preferably reinforced to handle the stress when crossbar tips 501 torque upward as the crossbar shaft flexes under a load. Dead-end wall 166 of the crossbar holder is likewise preferably reinforced to prevent breakage in case the hanger tips over and thrusts the lower tip of the crossbar against it with the weight of garments clamped to the rod. Note that the floor of the crossbar holder need not be flat, since when laden with clothing, the crossbar shaft bends according to the weight of its burden and only makes contact with a tiny portion of the floor anyway. The free end 164 of the crossbar-holder floor is blunt to avoid snagging or tearing clothing or injuring the user. To further prevent snagging or tearing the garment, the blunted exposed proximal edge of the proximal side wall (the fore wall on the right end, the aft wall on the left end in FIG. 1, 2) is preferably congruent with the arch of the rail bottom. In the preferred embodiment for cheap hangers, to permit the crossbar holder to be formed with the same molds used for the rail as a whole, in the preferred injection-molded embodiment, the walls of the crossbar holder are panelled to alternate longitudinally along the crossbar, with fore wall 163 flanking one rail face and aft wall 161 flanking the other face, and with an opening opposing each wall on the opposite face so that the opposite mold can reach through to form the other face of the wall. Chink 162 leaves space between the two sections of wall for the molds to form the adjoining edges of the wall. The fore wall and aft wall are designed to hold the crossbar rod in place laterally.

In an alternative embodiment (FIG. 4, 5), more difficult to manufacture with injection molding but preferred for deluxe hangers for its tighter tolerance and sleeker look, the crossbar holders 16 are simply horizontal bores slightly larger in diameter than crossbar shaft 50 and reinforced with bosses, completely covered with fore and aft walls 161. In another alternative embodiment (not shown), one or preferably both of these bores penetrate end wall 166 to admit the crossbar rod 5 through the end of the rail from beyond, permitting a much stiffer rod to be used, so that heavier garments can be draped over the rod without gathering in the middle as the rod sags under their weight, and leading crossbar rod tip 501 is retained in the frame by a crimp applied through a window in wall(s) 160, 161 after insertion or annular crimps applied to the leading end of the rod and forced into the bore during assembly, similarly to the alternatives discussed for retaining suspensor hook 3; and by a preformed head on the trailing end. In yet another alternative embodiment (not shown), crossbar 50 is retained at both ends in crossbar holders 16 and held under tension by crimps, knots, welds, glue, or another suitable method, to permit a cheaper tensile material such as a thick plastic strand or cord with no appreciable intrinsic stiffness. In an alternative embodiment (not shown) designed to increase handroom 167 above the crossbar, crossbar shaft 500 is bent into a flat-bottomed U-shape whose ends 501 ascend into crossbar holders 16 bored vertically into the ends of the rail from below, and are barbed or crimped to retain the crossbar in the crossbar holders. In still another alternative embodiment (not shown), the crossbar shaft is bent into a U-shape whose ends are bent inward to enter the rail horizontally through top flange 10 from outside the peripheral ends, rather than through bottom flange 12 from inside, both to increase the handroom 167 above the rail and so that flexing the rod under the weight of trousers or other garments tends to pull the ends of the crossbar more tightly into the rail; and the stems of the U are prevented from swinging freely by grooves in the top flange leading downward from the crossbar-holder orifices to stop the crossbar in the vertical position during use, and leading forward and backward from the orifices to stop the crossbar in a horizontal position during operation to facilitate hanging trousers.

Carriage 2 may be fashioned of plastic, as shown here, or metal, laminated wood, or any other materials of suitable strength and stiffness to be supported by suspensor 3 and to in turn support rail 1 and crossbar 5 bearing heavy garments. The carriage consists of optional escutcheon 20, tube 21, catch 22, optional ganging hook 23, and optional lifters 24.

Roof 212, walls 213, and floor 214 in the lower part of the carriage form a tube 21 whose channel 218 (FIG. 3) admits easy passage of rail 1 as the carriage travels between the center of the rail, where the carriage rests during use, and check 153 near either end of the rail, where the carriage is held while inserting or extracting the frame through a narrow garment neck opening. Wiggle room or play 219 (FIG. 3) is left in the channel between the rail and the carriage, large enough to allow for manufacturing tolerance such that the carriage glides smoothly, but small enough to minimize rattling and to bar entry of knit silk and other fine fabrics. In the preferred I-beam rail embodiment, the carriage channel is tapered downward to match the difference in thickness between rail top flange 10 and bottom flange 12, both to conserve material and to reduce the amount of wiggle and rattle between the carriage tube and the rail, especially when the rail is nestled into the bottom of the channel during normal duty. In the preferred embodiment, the tube is elongated to support escutcheon 20 with collar supports 201, to prevent the rail from jamming inside tube 21, and to prevent the rail from pitching and capsizing. The bore of the tube channel is uniform throughout the length of the tube in the preferred embodiment, to prevent carriage lips 210 from catching on strap hangers 13 and detents 14, and for ease of manufacture, especially for a solid-walled tube. In an alternative embodiment, the carriage roof is arched higher longitudinally to permit the rail to have nonuniform curvature, for example to permit the rail ends to droop below the uniform arch of bottom flange 12 in order to leave more handroom 167 above crossbar 5 and to further reduce the formation of shoulder nipples in garments whose shoulder span is wider than the rail length.

The preferred deluxe embodiment for deluxe hangers (FIG. 4 . . . 6) has solid tube walls 213, for their sleeker look, to reduce rattling, and to minimize the risk of pinching fabric or fingers between tube lips 210 and strap holders 13 and skirt-loop holders 15. In this case, the paired tube walls may be thinned to conserve material, while roof 212 and floor 214 of carriage tube 21 remain reinforced to bear the weight of a heavy garment. However, the channel 218 (FIG. 6) of a one-piece solid-walled tube requires one or two additional interior mold pieces (side-cores) removable along the arc of the tube channel during manufacture by injection-molding, as well as additional retractable mold elements (lifters) to form optional spring bays 211. Accordingly, in the preferred low-cost embodiment (FIG. 1 . . . 3), walls 213 consist of panels alternating longitudinally between the two faces, such that wherever a panel 213 appears on one wall, the opposite wall of the tube has an opening 216 for a mold or other shaping process to reach through from the other side, to permit the channel of the carriage tube to be formed with the same mold pieces or shaping process used for the exterior of the carriage. In this case the unpaired wall panels are kept thick to maintain strength. Chinks 215 between tube wall panels on opposite faces make it possible to form the edges of the panels during injection molding. Lest the corners of the carriage roof and floor jut out to pinch fingers or snag the garment neck and seams, in the preferred embodiment neither wall terminates with an opening 216; instead, each terminates with an additional panel 213 beyond the collar support 201, and the carriage roof and floor extend diagonally (FIG. 2) to form a continuous lip 210 surrounding the rail. In the preferred embodiment, the wall panels and openings are arranged to so that the carriage tube is rotationally symmetrical about the vertical axis so that the same mold shape or shaping process can be used for both faces. The lips at all exposed edges of the carriage tube are smoothed and rounded to prevent injuring the operator, damaging the garment, catching the lip on strap-holder prongs 131, 135, and jamming the rail in the carriage. In an alternative embodiment (not shown), the tube is manufactured in two parts which are snapped, glued, welded, or fused together, bound together by rings or clips around the tube ends or the escutcheon, or otherwise securely joined together.

In an alternative embodiment (not shown) designed to conserve material at the expense of reduced strength, carriage tube 21 does not form a complete tube entirely surrounding rail 1, instead wrapping only around rail top flange 10, in the cross-sectional shape of a concave-downward C leaving a longitudinal gap along the entire center of carriage floor 214 for the passage of rail web 11; and strap hangers 13, when present, omit ends 130, 137 to admit the passage of the inner edges of carriage floor. In another alternative embodiment (not shown) designed to provide broader shoulder supports without increasing the overall thickness of the hanger, rather than wrapping carriage roof 212 downward around rail top flange 10, the rail top flange wraps upward around the carriage roof in the cross-sectional shape of a concave-upward C leaving a longitudinal gap the length of the carriage travel along the rail for the passage of escutcheon plate 202; and collar supports 201 stop short of the carriage roof to admit the passage of the inner edges at the top of the rail top flange. In yet another alternative embodiment (not shown), designed for hangers with soft padding around a stiff rail, the floor 214 of carriage tube 21 bears an internal T-shaped ridge around which wraps the embedded rail's bottom flange 12, which along with the padding has a longitudinal gap the length of the carriage travel to admit passage of the stem of the T.

Catch 22 is designed to catch on any of three stops 14 along the rail, in order to hold the carriage in place at either end of the rail during operation and at the center of the rail during normal duty. In the preferred embodiment, protruding catch 221 is situated on the carriage while recessed stops 141 are situated on the rail, rather than the other way around, to minimize the number of catch springs 220, and to keep rail bottom 12 smooth to avoid catching the lip of the carriage, snagging the clothing, or hurting the operator. Although catch 22 can be placed anywhere in carriage tube 21 or on carriage lip 210, in the preferred embodiment it is centered on carriage floor 214. Placing the catch inside the carriage tube keeps it from snagging clothing and pinching fingers. Centering the catch on the carriage floor ensures that during normal use, with the carriage centered on the rail and the weight of the clothing more or less balanced, the catch is forced into central detent 141 by the weight of the rail, holding the carriage more firmly in place. Centering the catch in the carriage makes it possible to use the same shape mold or shaping process for each face of the carriage, and simplifies assembly by making the relative orientation of the carriage and rail inconsequential.

To facilitate manufacture, the wall panels 213 abutting catch 22 preferably skirt around catch knob 221, leaving aperture 217 through which to reach in from each side and form the catch knob.

Catch knob 221 is optionally subtended by spring 220 whose force causes catch knob 221 to snap into each detent 141. In the preferred injection-molded embodiment, the spring is a leaf spring formed as part of carriage 2, attached to carriage floor 214 only at one or both ends, and detached along its sides by slots 222 (FIG. 2) to permit it to flex freely, where the height of the catch knob and the amount of vertical wiggle room 219 (FIG. 3) between the bottom of rail bottom 12 and the top of carriage floor 214 are dimensioned to ensure that the spring causes the catch to snap perceptibly into the stop even under the maximum wiggle room 219 (FIG. 3), when the carriage is resting on the rail. In an alternative embodiment, to avoid the additional mold piece required to form the leaf spring, this leaf spring is omitted, in which case the height of the catch knob is reduced to permit catch to fit within the vertical wiggle room. If leaf spring 4 is also omitted, then catch 22 passively engages stops 14 by the action of gravity alone. The preferred embodiment uses leaf spring 220 rather than leaf spring 4, both to reduce the number of parts to manufacture and assemble and to keep carriage roof 212 pressed down against rail top flange 10 to prevent fine fabrics from getting caught in the gap between the carriage roof and the rail top flange. In alternative deluxe embodiment (not shown), one or more integral springs formed as part of the carriage wall 213 or between the carriage wall and the rail 1 prevent or damp lateral wiggle and rattle.

In the preferred embodiment, the top of carriage tube 21 bears escutcheon 20 featuring a large web 202 whose flat faces are suited for branding or other labeling, as well as for the operator to grip the carriage by while manipulating the hanger in and out of garments and suspending and removing the hanger from clothes rods and other perches. In an alternative embodiment, suspensor is attached atop flange 200, leaving the escutcheon completely flat for ease of labeling, at the expense of structural strength. In another alternative embodiment, suspensor 3 is attached directly to the carriage tube without an escutcheon to conserve material, likewise at the expense of structural strength.

The rim 200 of escutcheon 20 is blunted to avoid injury to the operator and clothes. Distal parts of the rim are sloped and curved concave-outward to form collar supports 201 for garments with collars of various heights and diameters, and are wide and rounded to support the collar without deformation.

Bore 205 is designed to receive suspensor shank 305, and is preferably straight, cylindrical, and slightly larger than the shank, to permit suspensor 3 to swivel freely about the yaw axis while preventing pitching and rolling about the suspensor-carriage joint, which, introducing a pivot lower than the top of suspensor 3 and closer to the garment's center of gravity, would increase the risk of the frame's listing and dropping the garment. The bore is moreover preferably centered in the carriage and perpendicular to the rail to permit the hanger to swivel freely when suspended. The bore is reinforced with boss 203. In the embodiment shown, the shank is retained by a large crimp 307 applied through crimping window 204 after insertion, as in U.S. Pat. No. 3,191,770. The top of the crimping window is perpendicular to the bore, to prevent the crimp from binding as it rotates within the bore and scrapes against the top of the window, and to prevent optional washer 306 from wobbling. In an alternative injection-molded embodiment, for cheaper hangers, the bore is formed by breaking up the boss into alternating panels on opposite faces of escutcheon 20, as shown similarly for carriage tube walls 213 and crossbar hanger walls 163, 161 in FIG. 1, to permit the bore to be formed by the same pair of molds that form the faces of the carriage, but at the expense of looser tolerance and increased rattling of the suspensor in the bore. In another alternative embodiment, the shank is retained by barb-like annular crimps applied beforehand and forced into the bore, in which case the crimping window is superfluous. Also, in the embodiment shown, the bore, the boss, and shank 305 extend through to the bottom of escutcheon plate 202, for maximum strength. In an alternative embodiment, the boss is mounted atop escutcheon rim 200, and shank and bore do not penetrate the escutcheon plate, thus conserving material and leaving the faces of the plate entirely flat and free for branding and labeling. In another alternative embodiment, to conserve material, escutcheon 20 is omitted altogether and the shank bore boss is mounted directly atop roof 212 of carriage tube 21.

Carriage 2 optionally bears ganging link 23 to permit two or more hangers to be ganged together by inserting the suspensor hook of a second hanger through the hole 231 of the ganging link and suspending it from bridge 233, where posts 230 suspend the bridge and retain the hook in the hole. In the preferred embodiment, as depicted here, the ganging link is tucked out of the way beneath carriage floor 214 to avoid entanglement with the garment, other hangers, and the operator's hands; and is centered under the carriage directly beneath suspensor bore 205, in order to avoid unbalancing the hanger. In the preferred embodiment, as shown here, the ganging link forms a closed loop with two posts 230, bridge 233, and carriage floor 214 fully encircling hole 231, rather than an open hook, to avoid snagging the garment or the operator's hands. Moreover, in the preferred embodiment, as shown here, the posts are offset from each other both laterally and longitudinally, and the upper surface of the bridge is flat or grooved 232 in both the lateral and longitudinal direction in order to permit a clothes hanger with a non-swiveling suspensor hook to be suspended from the ganging link either parallel or perpendicular to this hanger, as well as to permit the ganging hook to be formed from the faces by the same molds or shaping process used for shaping the faces of the rest of the carriage. Furthermore, in the preferred embodiment, the shape of the ganging link is rotationally symmetrical about the central axis of the carriage, to permit the same shape mold or other shaping process to be used for each face of the carriage.

When removing a garment from the hanger, pushing the end of the rail toward the carriage tends to ruffle the yoke or shoulder material of the garment, which might then sag into strap-holder gap 133 and jam between the strap holder and the carriage lip. Thus when rail 1 is outfitted with strap holders 13, in the preferred embodiment carriage walls 213 are extended with lifters 24 to lift fine supple fabrics such as silk knits out of skirt-holder gaps 133 as the carriage approaches the end of the rail when removing a garment from the hanger.

Suspensor 3 may be fashioned of stiff wire, as shown here, or of rigid plastic tubing, bent wood, or any other material of suitable strength and stiffness to support the weight of clothing on the hanger. In the preferred embodiment, as depicted here, the suspensor is in the form of a large hook, permitting the garment to be removably suspended from a clothes rod or any other suitable purchase. However, the invention is equally effective with other forms of suspensor, and in fact this invention uniquely facilitates hanging or removing a garment in place, while the hanger remains suspended, a feature particularly useful for hangers irremovably attached to a clothes rod with security suspensors. In the preferred embodiment, as depicted here, the suspensor is mounted on the carriage in such a way as to permit it to swivel freely about the axis of its shank, making the orientation of the frame independent of the orientation of the suspensor, so that the hanger does not have to be turned around in order to thrust it straight onto a clothes rod, and the garment does not have to be rehung if it is facing the wrong way for presentation. In an alternative embodiment, the suspensor is of a piece with the carriage, and does not swivel.

Concave-downward semicircular bend 300 in hook is sized and shaped to conveniently admit any standard clothes rod. Point 301 is blunted by folding back or rounding the point to avoid injuring operators, tearing garments, or scratching clothes rods. Gap 303 between point 301 and diversion 304 of the hook is large enough to easily accommodate any standard clothes rod when thrusting the hanger horizontally straight onto the rod. In the preferred embodiment for deluxe hangers, tip 301 (FIG. 4) is enlarged into a spherical bead to precisely counterbalance the inertial moment of the back 302 of the hook about the vertical axis of shank 305, so that pitching and rolling motions of the frame do not cause the suspensor to swivel and lose its orientation relative to the frame, both for a more elegant look and to minimize entangling the suspensor hook with those of other hangers and with other articles.

In the preferred embodiment, back 302 of the suspensor hook is straight and perpendicular to the center of the rail, rather than curved or sloping, so that pressing any part of the back against a clothes rod will automatically swivel the hook around properly for hanging on the clothes rod; and so that the impact of ramming the hook against a clothes rod against a clothes rod imparts no downward deflecting force on the carriage, lest the catch disengage from the rail and permit the rail to slide forward and dump the garment on the floor.

Figures 4, 5, 6:
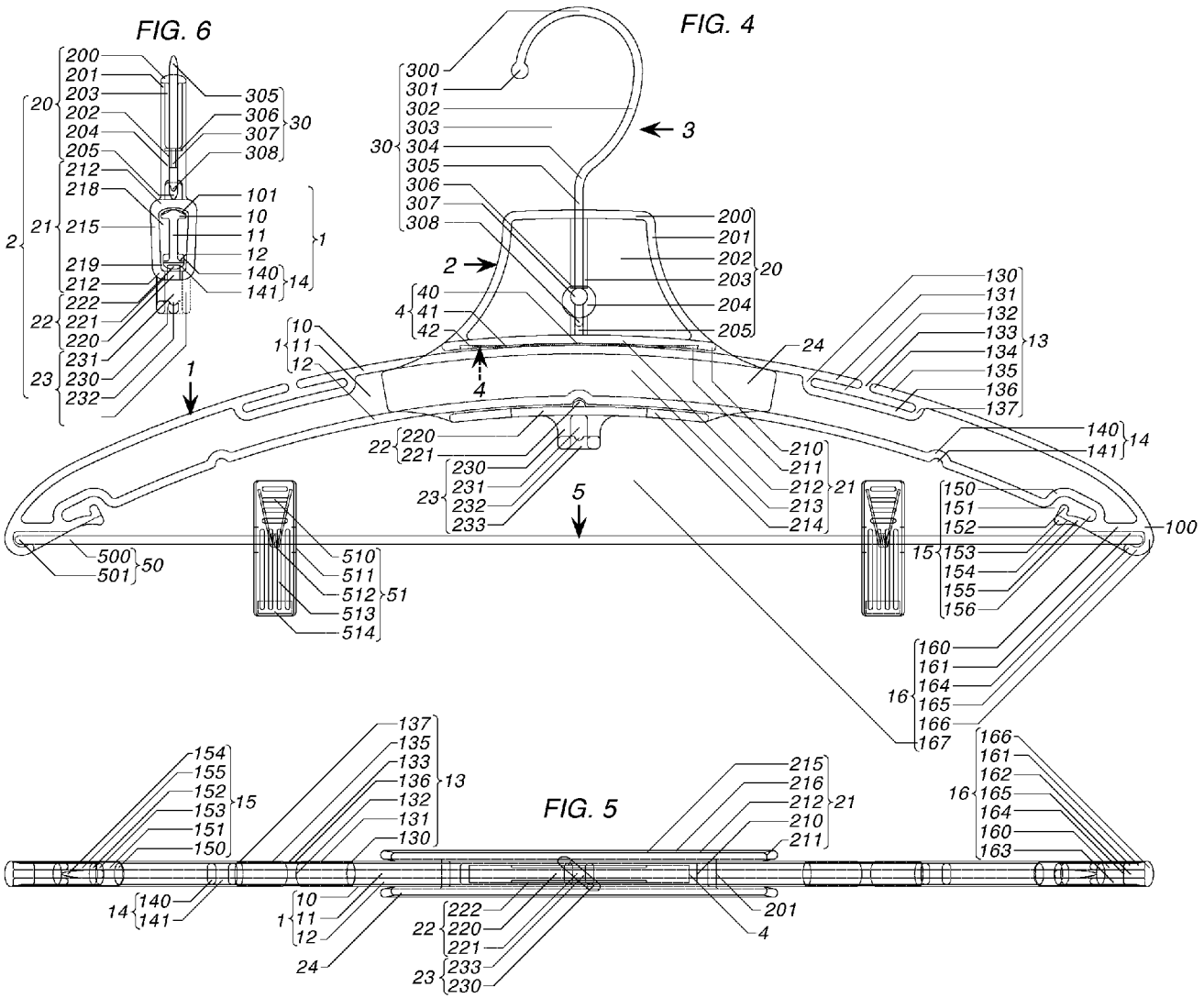
FIG. 4 illustrates an elevation view of an embodiment of the invention using deluxe plastic I-frame construction.
FIG. 5 illustrates a bottom view of an embodiment of the invention from FIG. 4 without the crossbar.
FIG. 6 illustrates a central cross-section view of an embodiment of the invention from FIG. 4 without the crossbar.

Shank 305 of suspensor 3 is straight and perpendicular to the rail, to permit the hook to swivel freely during operation and use. One or more crimps 307 in the shank bulge to irremovably attach the shank to the carriage. The crimp shown here is applied after assembly, through window 204 in escutcheon plate 202. Optional washer 306, preferably of the same hardness as crimp 307 to avoid uneven wear, permits the hook to swivel more smoothly and prevents the edges of the crimp from eroding the bore. In embodiments wherein the hook and washer are both metal, they are preferably made of the same metal to avoid galvanic corrosion in damp environments. In an alternative embodiment, crimps such as ring-shaped barbs are applied beforehand and forced into bore 205 during assembly. Tip 308 of the shank is preferably tapered and rounded to facilitate insertion into bore 205 of the carriage. In the preferred embodiment for deluxe hangers, as shown in FIG. 6, the tip 308 of the suspensor shank is tapered in one dimension, matching a tapering at the base of bore 212, so that when the hanger is lifted off the clothes rod or other purchase and the suspensor falls to rest at the bottom of the bore, the suspensor hook automatically aligns itself in the plane of the hanger frame, the taper being sufficiently abrupt so that deliberate swiveling of the suspensor hook pushes it upwards to rotate freely, a feature intended both for a sleeker look and to minimize snarling with the hooks of other hangers and with other articles. As a further refinement (not shown), a snap fitting, preferably in the floor of crimp window 204, permits the operator to push the suspensor further into the bore in order to maintain this alignment even when the hanger is upside-down, for example for shipping.

Spring 4 is an optional suspension device designed to hold the carriage aloft against the force of gravity and inadvertent jiggling, so that catch 22 actively engages stops 14 except when the operator presses carriage 2 down against rail 1 to release the catch in order to slide the carriage along the rail before or after passing the frame through the neck opening of a garment. The spring may be fashioned of spring steel, as shown here, or of any other suitably resilient and strong material. In the preferred embodiment, the spring is a W-shaped leaf spring with two convex-downward arches 41 pressing downward against rail top 10 from opposing sides of the central catch in order to force catch knob 221 into stop detent 141 even under an imbalanced load, for example when the hanger is held by the carriage at one end of the rail during operation. The contact regions of upper arch 40 and lower arches 41 at maximum compression of the spring are designed to be located at carriage wall chinks 215 to constrain the spring on both sides and prevent it from slipping out of wall openings 216. The curvature of the lower arches is designed to be gradual enough to avoid catching the spring in strap-holder gaps 133. The upper arch of the leaf spring is located centrally so that it presses against carriage roof 212 where carriage escutcheon 20 is reinforced with suspensor shank bore boss 203. The leaf spring is sized long enough for spring ends 42 to press against the carriage roof directly beneath fortifying collar supports 201, where bays 211 in the carriage roof receive the leaf-spring ends and prevent the spring from slipping out through channel 218 in wiggle-room gap 219 between rail top 10 and the carriage tube roof, yet short enough that even when fully extended under compression, the spring ends do not butt up against the distal ends of the bays. The leaf spring is flat in cross-section on its top surface (FIG. 3) and sized in width to fit snugly between carriage walls 213 to prevent it from twisting and jamming; and is flat in cross-section on its lower surface (FIG. 3) to ensure that it is tangent only with the central ridge of the cambered rail top, to minimize friction between the spring and the rail and to permit the rail top to be textured on its flanks 101 to prevent wide-necked garments from slipping down or off the rail. In an alternative embodiment, spring 4 is inserted between the top of rail bottom flange 12 and the bottom of one or more flanges added for that purpose protruding inside carriage walls 213.

Optional crossbar 5 may be fashioned of stiff springy wire, as shown here, or of stiff plastic, wood, or any other material of suitable strength and stiffness to support the weight of a garment on the crossbar without sagging so much as to cause clothing draped over it to slide toward the center and crumple; flexible enough to be bent and inserted into crossbar holders 16 during assembly; and resilient enough to spring back into shape after assembly. Tips 501 of crossbar rod 50 are tapered and blunt to facilitate inserting them into crossbar holders 16 and clamps 51. Crossbar 5 is designed to be mounted on rail 1 after carriage 2 is mounted on the rail.

Crossbar 5 may optionally be outfitted with clamps 51 to hold garments such as skirts, half-slips, and trousers without draping them over the rod, to avoid creasing from the narrow rod. The clamps may be fashioned of sheet metal, as shown here, or of plastic, or any other material of suitable strength and stiffness to bear the weight of a garment under the force of coil spring 512. When all or any two of crossbar 5, clamp 51, and spring 512 are metal, they are preferably made of the same metal to avoid galvanic corrosion in damp environments. In the preferred embodiment, clamp 51 is composed of two similar parts nesting or overlapping from opposite faces, with flanges 511 perforated to admit crossbar shaft 500, along which they can slide to any desired position to fit garments of different sizes. The bottom of clamp 51 is held firmly shut by coil spring 512, which also hold the clamp in place along the rod, in order to stretch the clamped garment. The upper outer face of each half of the clamp bears knurls 510 for better grip by the user. The remainder of each face of the clamp is reinforced with ribbing 513 to prevent deformation by the force of coil spring 512. Pads 514 on the inside of each half of the clamp grip the clamped garment, and are made of rubber or a similar elastic material to distribute the force over the fabric of the garment, and are non-slippery to keep the garment from slipping under gravity.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A hanger assembly for a garment including a neck opening and a pair of shoulder areas, comprising:

a rail having a pair of free lateral ends, each free lateral end configured to support one shoulder area of the pair of shoulder areas from inside the garment wherein said rail includes an envelope of uniform curvature extending from a particular free lateral end to an other free lateral end; and a carriage, coupled to said rail to transition between a pair of locations along said rail with said pair of locations including a first location generally centered between said pair of free lateral ends and a second location closer to said particular free lateral end than said other free lateral end, said carriage having a suspending mode wherein said carriage is located at said first location and an insertion-removal mode in which said carriage is located at said second location;

wherein said carriage includes a channel having a roof, a floor, and a channel height between said roof and said floor, wherein said rail includes a top rail surface, a bottom rail surface and a rail width between said top rail surface and said bottom rail surface extending from said first location to said second location, wherein said channel width closely matches said rail width with said carriage configured to engage said rail by passing said particular free lateral end through said channel when said carriage is decoupled from said rail;

wherein said lateral arms of said rail are generally disposed in a plane, wherein said carriage includes a hook to engage an object for suspending said carriage and said rail from said object, a shank tip, and a shank bore bottom, and wherein said shank tip and said shank bore bottom are matchingly tapered in one dimension wherein said hook automatically aligns itself with said plane when said rail hanger is lifted and said hook disengages from said object.

2. A hanger assembly for a garment including a neck opening and a pair of shoulder areas, comprising:

a rail having a pair of free lateral ends, each free lateral end configured to support one shoulder area of the pair of shoulder areas from inside the garment wherein said rail includes an envelope of uniform curvature extending from a particular free lateral end to an other free lateral end; and a carriage, coupled to said rail to transition between a pair of locations along said rail with said pair of locations including a first location generally centered between said pair of free lateral ends and a second location closer to said particular free lateral end than said other free lateral end, said carriage having a suspending mode wherein said carriage is located at said first location and an insertion-removal mode in which said carriage is located at said second location;

wherein said carriage includes a channel having a roof, a floor, and a channel height between said roof and said floor, wherein said rail includes a top rail surface, a bottom rail surface and a rail width between said top rail surface and said bottom rail surface extending from said first location to said second location, wherein said channel width closely matches said rail width with said carriage configured to engage said rail by passing said particular free lateral end through said channel when said carriage is decoupled from said rail;

including a flat-bottomed U-shaped crossbar having a pair of inward-bent ends coupled to said rail from outside, wherein a flexing of said crossbar under a weight of garments supported by said pair of free lateral ends tends to pull said pair of free lateral ends more tightly into said rail.

3. The hanger assembly of claim 2 in which said crossbar is held in a downward orientation by one or more vertical grooves disposed in an outer surface of said rail to inhibit said crossbar from unwanted swinging.

4. The hanger assembly of claim 3 in which one or more horizontal grooves enable said crossbar to be snapped into sideward orientation for ease of hanging and unhanging bulky garments over said crossbar.

5. A hanger assembly for a garment including a neck opening and a pair of shoulder areas, comprising:

a frame having a pair of lateral ends, each lateral end configured to support one shoulder area of the pair of shoulder areas from inside the garment; and a suspensor, coupled to said frame to transition between a pair of locations along said frame with said pair of locations including a first location generally centered between said pair of ends and a second location closer to a particular lateral end than an other lateral end, said suspensor having a suspending mode wherein said suspensor is located at said first location and an insertion-removal mode in which said suspensor is located at said second location; and wherein said lateral arms of said frame are generally disposed in a plane, wherein said suspensor includes a hook to engage an object for suspending said suspensor and frame from said object, a shank tip, and a shank bore bottom, and wherein said shank tip and said shank bore bottom are matchingly tapered in one dimension wherein said hook automatically aligns itself with said plane when said frame hanger is lifted and said hook disengages from said object.

6. A hanger assembly for a garment including a neck opening and a pair of shoulder areas, comprising:

a rail having a pair of free lateral ends, each free lateral end configured to support one shoulder area of the pair of shoulder areas from inside the garment wherein said rail includes an envelope of uniform curvature extending from a particular free lateral end to an other free lateral end; and a carriage, coupled to said rail to transition between a pair of locations along said rail with said pair of locations including a first location generally centered between said pair of free lateral ends and a second location closer to said particular free lateral end than said other free lateral end, said carriage having a suspending mode wherein said carriage is located at said first location and an insertion-removal mode in which said carriage is located at said second location;

wherein said carriage includes a channel having a roof, a floor, and a channel height between said roof and said floor, wherein said rail includes a top rail surface, a bottom rail surface and a rail width between said top rail surface and said bottom rail surface extending from said first location to said second location, wherein said channel width closely matches said rail width with said carriage configured to engage said rail by passing said particular free lateral end through said channel when said carriage is decoupled from said rail;

including a pair of skirt-loop holders disposed in said bottom rail surface, one skirt-loop holder at each said free lateral end, said skirt-loop holder including a moveable spur biased in a first position to engage said carriage at said second location and inhibit said carriage from disengaging from said rail when said carriage moves from said first location to said location and said moveable spur flexing in a second position enabling said particular free lateral end to pass through said channel when said carriage engages said particular free lateral end and moves from said second location towards said first location.

7. The hanger assembly of claim 5 wherein said suspensor includes a latching assembly in which said suspensor is snappable into a bore coupled to said shank bore, said latching assembly maintaining alignment of said hook with the frame as said frame is inverted and said frame is disposed above said suspensor.

8. The hanger assembly of claim 5 wherein a tip of said hook is enlarged into a bead that counterbalances an inertial moment of a back of said hook about an axis of a shank of the suspensor shank, to resist any swiveling of said shank in response to pitching or rolling motion of said frame.

* * * * *